US006103022A

United States Patent [19]

Komatsubara et al.

[11] Patent Number: 6,103,022

[45] Date of Patent: Aug. 15, 2000

[54] GRAIN ORIENTED ELECTRICAL STEEL SHEET HAVING VERY LOW IRON LOSS AND PRODUCTION PROCESS FOR SAME

[75] Inventors: Michiro Komatsubara; Toshito Takamiya; Kunihiro Senda, all of Okayama, Japan

[73] Assignee: Kawasaki Steel Corporation, Japan

[21] Appl. No.: 09/046,904

[22] Filed: Mar. 24, 1998

[30] Foreign Application Priority Data

Mar. 26, 1997 [JP] Japan ..... 9-073300

[51] Int. Cl.[7] ..... H01F 1/16

[52] U.S. Cl. ..... 148/308; 420/117

[58] Field of Search ..... 148/306, 307, 148/308; 420/117

[56] References Cited

U.S. PATENT DOCUMENTS

| | | | |
|---|---|---|---|
| 3,932,236 | 1/1976 | Wada et al. | 148/113 |
| 5,125,991 | 6/1992 | Ishitobi et al. | 148/308 |
| 5,702,541 | 12/1997 | Inokuti | 148/308 |
| 5,718,775 | 2/1998 | Komatsubara et al. | 148/308 |
| 5,858,126 | 1/1999 | Takashima et al. | 148/308 |

FOREIGN PATENT DOCUMENTS

| | | |
|---|---|---|
| 0 206 108 | 12/1986 | European Pat. Off. . |
| 0 345 936 | 12/1989 | European Pat. Off. . |
| 19 20 968 | 4/1971 | Germany . |
| 24 51 600 | 5/1975 | Germany . |
| 26 20 593 | 11/1976 | Germany . |
| 5-078743 | 3/1993 | Japan . |
| 5-186827 | 7/1993 | Japan . |

*Primary Examiner*—John P. Sheehan
*Attorney, Agent, or Firm*—Austin R. Miller

[57] ABSTRACT

In a grain oriented electrical steel sheet used for cores of transformers and generators, a high alignment degree of grain orientations reduces iron loss, by precipitating very fine AlN or/and BN and providing strong inhibiting effect against the growth of the primary recrystallized grains, providing radically improved texture and grain structure in the steel.

8 Claims, 2 Drawing Sheets

GRAIN ORIENTED ELECTRICAL STEEL SHEET HAVING VERY LOW IRON LOSS AND PRODUCTION PROCESS FOR SAME

BACKGROUND OF THE INVENTION

1. Field of the Invention

The present invention relates to a grain oriented electrical steel sheet used for cores of transformers and generators, specifically to a production process for a grain oriented electrical steel sheet having an ultralow iron loss.

2. Description of the Related Art

Grain oriented electrical steel sheets which contain Si, and have crystal grains strongly oriented to the (110) [001] orientation and the (100) [001] orientation, have excellent soft magnetic characteristics. This allows the grain oriented electrical steel sheets to be widely used as core materials for transformers and for generators used in the commercial frequency band.

Among characteristics required in such uses as core materials, it is important that the iron loss expressed as $W_{17/50}$ (W/kg) be low. Such loss is generally the loss observed when magnetization to 1.7 T is achieved in a frequency of 50 Hz. Electric power loss in transformers and generators can be substantially reduced by using materials having low $W_{17/50}$ values. Accordingly, grain oriented electrical steel sheets having improved low iron loss have been strongly required year by year.

In general, in order to reduce iron loss of a grain oriented electrical steel sheet, several methods are available. One is a method in which the Si content is increased, another in which thickness of the steel sheet is reduced, another in which crystal grain diameter is reduced, and still another in which the alignment degree of the crystal grain orientation is increased.

The electric resistances are also elevated in these methods, and therefore the eddy current loss out of the iron losses is lowered. The magnetic flux density is enhanced in the methods, and therefore the hysteresis losses out of the iron losses are reduced.

However, excess addition of Si deteriorates the rolling workability and processability, and therefore is limitative and not preferred. The method is further limitative since it requires extreme increase of production cost. Also, since excessive reduction of crystal grain diameter lowers the alignment degree of the crystal grain orientations and increases hysteresis loss, the iron loss undesirably grows larger.

The subject has so far been thoroughly investigated.

Disclosed in, for example, Japanese Examined Patent Publication No. 46-23820 is a technique in which Al is added to a steel and fine AlN is precipitated by hot rolled sheet annealing at high temperatures of 1000 to 1200° C. after hot rolling and quenching treatment following with cold rolling at a high rolling reduction of 80 to 95%. A very high magnetic flux density of 1.95 T in $B_{10}$ (magnetic flux density in a magnetic field of 1000 A/m) is obtained by this method. According to this method, AlN finely dispersed and precipitated has a strong action as an inhibitor controlling the growth of primary recrystallized grains. Only nuclei having excellent grain orientations are secondarily recrystallized by strong inhibiting effect to provide products having a crystal grain structure with excellent orientations. In this method, however, crystal grains are usually coarsened, and the eddy current loss grows larger. Accordingly, it is difficult to obtain a low iron loss. Further, it is difficult to make AlN completely solid solute in hot rolled sheet annealing, and therefore it has been difficult to stably obtain products having a high magnetic flux density.

Further, disclosed in Japanese Unexamined Patent Publication No. 2-115319 is a method in which Sb is further added to steel as a segregation type inhibitor to carry out a specific final annealing method. A product having a high magnetic flux density was obtained by this method, but the grain orientation alignment degree was not satisfactory. When the Sb content was increased in order to obtain a product having a higher alignment degree, the secondary recrystallization became unsatisfactory, and the iron loss was degraded to a large extent.

Further, disclosed in Japanese Examined Patent Publication No. 58-43445 is a method in which a steel containing 0.0006 to 0.0080% of B and 0.0100% or less of N is used to devise decarburization annealing. A magnetic flux density of 1.89 T in $B_8$ (magnetic flux density in a magnetic field of 800 A/m) was obtained by this method. This method provides products having relatively stable magnetic characteristics and therefore is preferred from a practical point of view. However, this method has not become industrial because the magnetic flux density is low and the iron loss is not good.

Further, disclosed in Japanese Examined Patent Publication No. 54-32412 is a technique in which S or Se is used in combination with a member of the group of As, Bi, Pb, P, Sn, Cu or Ni. The high magnetic flux density was relatively stably obtained by this method, but the iron loss was not good.

Separately from these techniques, disclosed in Japanese Unexamined Patent Publication No. 2-30718 is a method in which grooves are provided on the surface of a product sheet by forming grooves on the surface of a steel sheet after cold rolling, and the eddy current loss is reduced to lower the iron loss. According to this method, however, the magnetic flux density is reduced and the hysteresis loss grows larger, and therefore a large iron loss reduction effect is not obtained.

Further, disclosed in Japanese Unexamined Patent Publication No. 5-345921 is a technique in which a prescribed amount of Ni is provided according to the ratio of Si content to C content in a grain oriented electrical steel sheet containing AlN, MnS and Cu and Sn as inhibitors. However, the product did not have a satisfactory grain orientation alignment degree, and the iron loss was not good.

As described above, the alignment degree of grain orientation has to be increased stably in order to reduce the iron loss of a grain oriented electrical steel sheet. Higher alignment of grain orientation makes it possible stably to obtain an excellent iron loss value.

An object of the present invention is to provide a technique for highly aligned grain orientations.

In conventional techniques, the crystal grain diameter inevitably increases when the alignment degree of grain orientations is raised. As a result, eddy current loss is increased, and iron loss value is degraded in a certain case. Accordingly, such techniques are unstable in terms of production conditions.

In contrast with this, the alignment degree of grain orientation is inevitably lowered when crystal grains are attempted to be refined. As a result, magnetic flux density is reduced, hysteresis loss grows largerr and iron loss value is reduced in some cases. Accordingly, such technique is unstable as well in terms of production conditions.

That is, in conventional techniques, refining of crystal grains could not be compatible with high alignment of grain orientations. Accordingly, materials having a very high magnetic flux density and a low iron loss could not stably be produced.

Another object of the present invention is to cause the conditions of a crystal grain, which have so far been inconsistent, to stand together and to resolve them radically. That is, in a production process for a grain oriented electrical steel sheet using AlN as an inhibitor, an object of the present invention is to provide a technique for obtaining a very high $B_8$ value and solving the instability of coarsening of crystal grain diameter of the product.

SUMMARY OF THE INVENTION

In order to achieve the object described above, we have focused upon a method for precipitating AlN which is an inhibitor to develop a method which is completely different from conventional methods.

According to the present invention, AlN can be precipitated very finely. As a result, it becomes possible to obtain strong restraint against growth of primary recrystallized grains. It has been found that the inhibitor can display a strong restraint, which has not so far been observed, by further causing Sb to be present in combination. Further, it has newly been found that in order to obtain stably a low iron loss, it is effective, for improving texture and grain structure, to add Ni, increase the Ni addition amount in a prescribed range according to the Sb content and reduce the C content according to the Sb content.

The present invention relates to a grain oriented electrical steel sheet having a very low iron loss, having secondary recrystallized grains in which an average of sheet facial rotation angles of grain orientations from the (110) [001] orientation falls within about 4 degrees, and crystal grains having a grain diameter of about 10 mm or more account for about 75% or more of area, and which grains have an average grain diameter of about 25 mm or less. The steel contains about 1.5 to 7.0 wt % of Si, about 0.005 to 2.5 wt % of Mn, Cu, Sn, Ge, Bi, V, Nb, Cr, Te and Mo expressed as a single amount, or a total amount of two or more species thereof, and about 0.005 to 0.30 wt % of P as inhibitor auxiliary elements, and further contains about 0.005 to 1.0 wt % of Ni, about 0.02 to 0.15 wt % of Sb and about 0 to 0.0050 wt % of B, and substantially satisfies the relationship:

$$0.02 \leqq Y \leqq 1.0,\ 5(X-0.05) \leqq Y \leqq 10X$$

wherein X represents Sb content (wt %), and Y represents Ni content (wt %)

It is limited in impurities to about 0.003 wt % or less of C, about 0.003 wt % or less of S and Se in total, about 0.003 wt % or less of N, about 0.002 wt % or less of Al and about 0.003 wt % or less of Ti, and the remainder incidental or inevitable impurities and Fe.

Further, the present invention relates to a production process involving heating to 1300° C. or higher a steel slab containing about 0.02 to 0.10 wt % of C and about 1.5 to 7.0 wt % of Si, about 0.010 to 0.040 wt % of Al and/or about 0.0003 to 0.040 wt % of B as inhibitor elements, about 0.005 to 0.025 wt % of S and Se alone or in combination and about 0.0010 to 0.0100 wt % of N, and about 0.005 to 2.5 wt % of Mn, Cu, Sb, Sn, Ge, Bi, V, Nb, Cr, Te and Mo expressed as a single amount or a total amount of two or more kinds thereof and about 0.30 wt % or less of P as inhibitor auxiliary elements, further containing Ni, and the remainder comprising other inevitable impurities and Fe, to carry out hot rolling, carrying out cold rolling once or several times to obtain a final thickness, and then carrying out final annealing after decarburization annealing. The following slab relationships are substantially satisfied:

$$0.02 \leqq Y \leqq 1.0,\ 5(X-0.05) \leqq Y \leqq 10X$$

$$0.02 \leqq Z \leqq 0.10,\ -0.6X+0.06 \leqq Z \leqq -0.6X+0.11$$

wherein X represents Sb content (wt %); Y represents Ni content (wt %) and Z represents C content (wt %). The outlet temperature of hot rolling is 900° C. or higher and about 1150° C. or lower; the heating rate is between about 700 to 900° C. in the first annealing over the temperature of 900° C. after hot rolling is controlled at about 2 to 30° C./second; and $H_2$ is present in the atmosphere at least from about 900° C. in the heating step in final annealing, and $N_2$ is present in the atmosphere at least up to about 1000° C.

DESCRIPTION OF THE PREFERRED EMBODIMENTS

Figure 1:
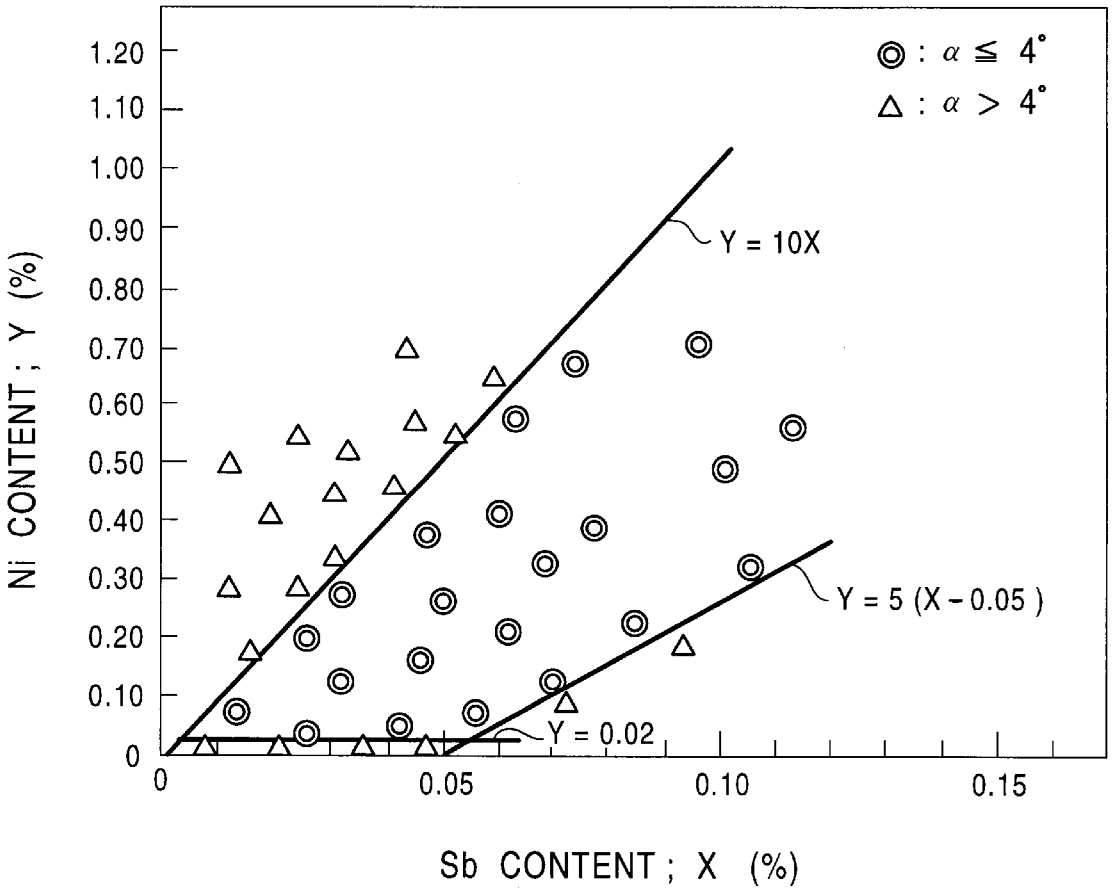
FIG. 1 is a drawing showing the influence exerted by Sb content and Ni content to an average of sheet facial rotation angle from the (110) [001] orientation in the grain orientation of secondary recrystallized grains contained in products according to the invention.

The following tests relating to the present invention are described to illustrate the invention by way of example. They are not intended to define or to limit the scope of the invention, which is defined in the appended claims.

Experiment 1:

Each two grain oriented electrical steel sheets with a thickness of 250 mm having various compositions, shown by the marks A, B, C, D, E, F and G in Table 4 which follows, were heated to 1390° C. to prepare hot rolled coils having a thickness of 2.2 mm by hot rolling. The hot rolling was finished at a temperature of 880° C. in one group of steel pieces (A-1, B-1, C-1, D-1, E-1, F-1 and G-1), and was finished at a temperature of 1010° C. in the other group of steel pieces (A-2, B-2, C-2, D-2, E-2, F-2 and G-2). After finishing the hot rolling, a large and sufficient amount of cooling water was sprayed on the surfaces of the steel sheets to cool them at a rate of 50° C./second, and the steel sheets were coiled at a steel sheet temperature of 550° C. The above hot rolled steel sheets were subjected to hot rolled sheet annealing in which the steel sheets were heated up to a steel sheet temperature of 1000° C. at a heating rate of 12° C./second and held at a steel sheet temperature of 1000° C. for 30 seconds. After hot rolled sheet annealing, the resulting steel sheets were pickled and rolled to a thickness of 1.8 mm by cold rolling, followed by subjecting them to intermediate annealing in which the steel sheets were held at a steel sheet temperature of 1100° C. for 50 seconds in a mixed atmosphere, having a dew point of 50° C., of 50% $N_2$+50% $H_2$. After subjecting the steel sheets to pickling treatment, they were subjected to cold rolling up to a final thickness of 0.22 mm at a steel sheet temperature of 220° C. After finishing cold rolling, grooves having a width of 100 $\mu$m and a depth of 20 $\mu$m were formed on the surfaces of the above steel sheets subjected to decreasing treatment in a direction perpendicular to the rolling direction at an interval of 5 mm in the rolling direction. After finishing the groove-forming treatment, the above steel sheets were subjected to decarburization annealing at a steel sheet temperature of 850° C. for 2 minutes. After finishing the decarburization annealing, an annealing separator comprising MgO containing 8% of $TiO_2$ was applied on the surfaces of the above steel sheets, and the steel sheets were wound up in the form of a coil. After winding up, the resulting coils were subjected to final annealing. In the final annealing, the heating rate was set to 30° C./h up to 800° C., 15° C./h at 800 to 1050° C. and 20° C./h at 1050 to 1150° C. Annealing atmospheric gases in heating were 100% $N_2$ up to 800° C., a mixture of 25% $N_2$ and 75% $H_2$ at 800 to 1050° C. and 100% $H_2$ at 1050 to 1150° C. After heating up to 1150° C., the sheets were kept for purification at the same temperature for 5 hours in a 100% $H_2$ gas atmosphere. The above steel sheets were then subjected to controlled cooling treatment down to a steel sheet temperature of 800° C. in $H_2$ gas atmosphere and natural cooling treatment at a steel sheet temperature of 800° C. or lower in $N_2$ gas. After final annealing, the unreacted annealing separator was removed from the surfaces of the steel sheets. After removing, a coating liquid comprising 50% of colloidal silica and 50% of magnesium phosphate was applied, and the steel sheets were subjected to baking to provide them with a tension coating, producing the products.

Test pieces of an epstein size (280L×30W) cut out of the respective products along the rolling direction were subjected to stress relief treatment at 800° C. for 3 hours, and then the iron loss values ($W_{17/50}$) in a magnetic flux density of 1.7 T and the magnetic flux densities ($B_8$) in a magnetic field of 800 A/m were measured. Further, the steel sheets were subjected to macro etching to determine the two-dimensional crystal grain distributions on the surfaces of the steel sheets and the sheet facial rotation angle averages ($\alpha$) of the crystal grains from the (110) [001] orientation in the crystal grain orientations. Further, the product sheet compositions were analyzed. The two-dimensional crystal grain diameter was determined by a circle-equivalent diameter. The crystal grain distribution was shown by an area proportion of each crystal grain diameter. Further, the crystal grain orientations were measured (excluding the abnormal values in the intergranular parts) in a face of 300 mm square at a pitch of 2.5 mm to determine $\alpha$ by averaging the sheet face rotation angles. The above results are shown in Table 1 together with the iron loss characteristics.

As shown in Table 1, $W_{17/50}$ was as good as 0.66 W/kg in the samples A-2 and F-2. In either case, the area proportion in a crystal grain diameter of 10 mm or more was 95% or more, and the area proportion in a crystal grain diameter of 2 mm or less was 4% or more. The average crystal grain diameter was about 10 mm in both cases. The $\alpha$ value was 4 degrees or less in either case. The sample A-2 contained 0.35 wt % of Ni and 0.068 wt % of Sb and had a high hot rolling temperature. The sample F-2 contained 0.04 wt % of Ni and 0.026 wt % of Sb and had a high hot rolling temperature as well.

On the other hand, as shown in Table 1, the samples (A-1, B-1, C-1, D-1, E-1, F-1 and G-1) in which the outlet temperatures of hot rolling were low were as deficient in $W_{17/50}$ as 0.82 W/kg or more. In all cases, the area proportions of the crystal grains in a crystal diameter of 2 to 10 mm were high, and the $\alpha$ values exceeded 4 degrees to a large extent.

In contrast with this, the samples (B-2, C-2, D-2, E-2 and G-2) in which the outlet temperatures of hot rolling were as high as 1010° C. were as deficient in $W_{17/50}$ as 0.78 W/kg or more.

In the samples B-2, C-2, D-2, E-2 and G-2, the area proportions of the crystal grains in a crystal diameter of 2 to 10 mm were low, and the area proportions of the crystal grains in a crystal diameter of 10 mm or more grew large as compared with those of the samples having the same composition in which the outlet temperatures of hot rolling were low, and the $\alpha$ values were decreased as well].

However, all of the samples B-2, C-2, D-2, E-2 and G-2 had large $\alpha$ values as compared with those of the samples A-2 and F-2.

B-2 contained more crystal grains of 10 mm or more and less crystal grains of less than 2 mm and had a large average crystal grain diameter as compared with those of F-2. It is considered that B-2 had a large orientation dispersion in the crystal grains of 10 mm or more and therefore the $\alpha$ value grew larger. B-2 contained 0.04 wt % of Ni and 0.065 wt % of Sb, which means that B-2 contained the same amount of Ni but more Sb as compared with that of F-2.

C-2 contained more crystal grains of 10 mm or more and less crystal grains of less than 2 mm as compared with those of A-2. It is considered that C-2 had a large orientation dispersion in the crystal grains of 10 mm or more and therefore the $\alpha$ value grew larger. C-2 contained no Ni and 0.067 wt % of Sb.

D-2 contained less crystal grains of 10 mm or more as compared with those of A-2. It is considered that D-2 contained more fine crystal grains and therefore the grain orientations were dispersed. D-2 contained 0.33 wt % of Ni and 0.067 wt % of Sb, which were almost the same as compared with those of A-2. D-2 contained 0.09 wt % of C, which was more than 0.06 wt % of C contained in A-2.

E-2 contained less crystal grains of less than 2 mm and more crystal grains of 2 to 10 mm and had a large average crystal grain diameter as compared with those of A-2. It is considered that E-2 had a large orientation dispersion in the crystal grains of 2 to 10 mm and therefore the $\alpha$ value grew larger. E-2 contained no Ni and 0.028 wt % of Sb.

G-2 contained less crystal grains less than 2 mm and more crystal grains of 2 to 10 mm and had a large average crystal grain diameter as compared with those of F-2. It is considered that G-2 had a large orientation dispersion in the crystal grains of 2 to 10 mm and therefore the $\alpha$ value grew larger. G-2 contained no Se and a small amount of S. That is, it is considered that G-2 had no ability to precipitate fine deposits such as MnS and MnSe into the steels in a hot rolling step, and therefore that excellent magnetic characteristics could not be obtained.

It has been confirmed from the results of Experiment 1 that it is particularly important for obtaining good magnetic characteristics to control Ni, Sb and C contained in the slab within appropriate ranges and elevate the outlet temperatures of hot rolling. When these were satisfied, a double-peak distribution was achieved in which fine crystal grains and coarse crystal grains grew larger in the crystal grains of the products, and the average crystal grain diameter became smaller. Further, the $\alpha$ value became smaller as well, and the alignment degree of the grain orientations was enhanced. The inhibitors of the good products before final annealing were investigated, and as a result thereof, it was found that fine AlN containing MnSe and CuSe as nuclei was compositely precipitated. Accordingly, it is important that the fine composite precipitate was formed.

It was very difficult in conventional hot rolling to precipitate AlN uniformly and finely as an inhibitor. However, we have found that when the outlet temperature of hot rolling is elevated, AlN can be inhibited from precipitating at the hot rolling stage. On the other hand, if inhibitor-forming elements such as Mn, Cu and Se are sufficiently provided, fine precipitates such as MnS and MnSe are formed. When the heating rate is controlled at the first (hot rolled sheet annealing in Experiment 1) heating step in an annealing process after hot rolling, very fine AlN can be precipitated on fine precipitates such as MnS and MnSe. In particular, it is effective to control the heating rate between about 700 to 900° C. which is a temperature range of composite precipitation to about 2 to 30° C./second.

It is beneficial that secondary recrystallized grains, which are inferior in the orientation of the crystal grains in an amount of less than about 10 mm, were inhibited from being produced.

Fine composite precipitates have a very strong inhibiting effect because Ostwald growth is inhibited. Further, Sb is segregated in a grain boundary to increase restraint, and has a strong inhibiting effect. If strong inhibiting effect is present, secondary recrystallized grains having very excellent orientations are produced.

However, both cases where the outlet temperature of hot rolling is elevated and where Sb is added face the problem that the hot rolled structure tends to deteriorate. When the temperature in hot rolling is raised to a large extent, the grain structure of the hot rolled sheet is not refined due to grain growth accelerated after hot rolling and a reduction in the γ transformation amount during rolling. Further, when Sb is contained in the steel in a high concentration, Sb inhibits recrystallization to thereby bring about deterioration in the grain structure in hot rolling. Since the hot rolled structure is degraded, a considerable number of crystal grains having inferior orientations come to appear in the secondary recrystallized grains of about 10 mm or more.

Accordingly, if Ni is present in the steel, the γ transformation amount during hot rolling is increased, and refining the grain structure of the hot rolled sheet can be achieved. Accordingly, the secondary recrystallized grains of less than about 10 mm which are inferior in orientation can be inhibited from being produced. Further, Ni tends to inhibit the secondary recrystallized grains from growing. In addition, the secondary recrystallized grains which are inhibited from growing and inferior in orientations are turned into crystal grains of 2 mm or less to have a function to stabilize the iron loss. As described above, the addition of Ni increases not only coarse crystal grains but also fine grains. Accordingly, the average crystal grain diameter is reduced.

However, when Ni is present in excess, the grain structure on the surface of the steel sheet is refined as well and degraded. Well known is a method in which a decarburized layer is provided on the surface of a steel sheet in annealing at a cold rolling step to accelerate the formation of nuclei for secondary recrystallization. However, if Ni is present in excess, the place of the decarburized layer provided on the surface causes partial γ transformation to bring about a reduction in the nucleus-forming frequency. As a result, good secondary recrystallization is not obtained.

In general, it is considered effective as well, for increasing the γ transformation amount, to raise the C content in the steel. However, C is likely to be diffused and therefore to be unevenly distributed in a grain boundary in a steel. That is, the ability of C for uniformizing a grain structure is quite small as compared with that of Ni. When the Sb content is high, decarburizing properties deteriorate, therefore increase of the C content is not preferred. Further, when the Sb content is high, the orientation alignment degree of grains contained in the product is reduced as well. That is, when the Sb content is high, the thickness of a decarburized layer on the surface of a steel sheet at an annealing step after hot rolling is reduced. A reduction in the thickness of the decarburized layer results in a reduction in nucleus-forming frequency in secondary recrystallization, and secondary recrystallization of the grains having good orientations can not be expected.

Elements such as Cu and Mn increase γ transformation as well. However, the elements such as Cu and Mn are bonded to S and Se to function as inhibitor auxiliary elements. That is, if the contents of the elements such as Cu and Mn are changed according to the Sb content, the inhibitor function is changed. Accordingly, it is not desirable to increase the amounts of elements such as Cu and Mn.

As described previously, in order to obtain secondary recrystallized grains having good grain orientations, the upper limit of Ni content has to be controlled according to Sb content. Measured for a were the products produced on the same production conditions as those of A-2 or F-2 described previously using various slabs obtained by changing the Sb and Ni contents and adjusting the others to almost the same composition as the slab marked by A in Table 4. The results thereof are shown in FIG. 1. The products of $\alpha \leqq 4°$ are shown by the symbol ⊙, and those of $\alpha > 4°$ are shown by Δ, wherein the abscissa was allotted to the Sb content (wt %), and the ordinate was allotted to the Ni content (wt %). It is confirmed that the area surrounded by $0.02 \leqq Y$, $5 \times (X-0.05) \leqq Y \leqq 10 \times X$ and $Y \leqq 1.0$ is an appropriate area, wherein Y (wt %) represents the Ni content, and X (wt %) represents the Sb content.

Further, the addition of Sb to the steel brings about a decarburization-inhibiting action. The C content has to be reduced according to the increase of the Sb content in order to secure sufficient decarburization amount to obtain secondary recrystallized grains having advantageous grain orientations.

Figure 2:
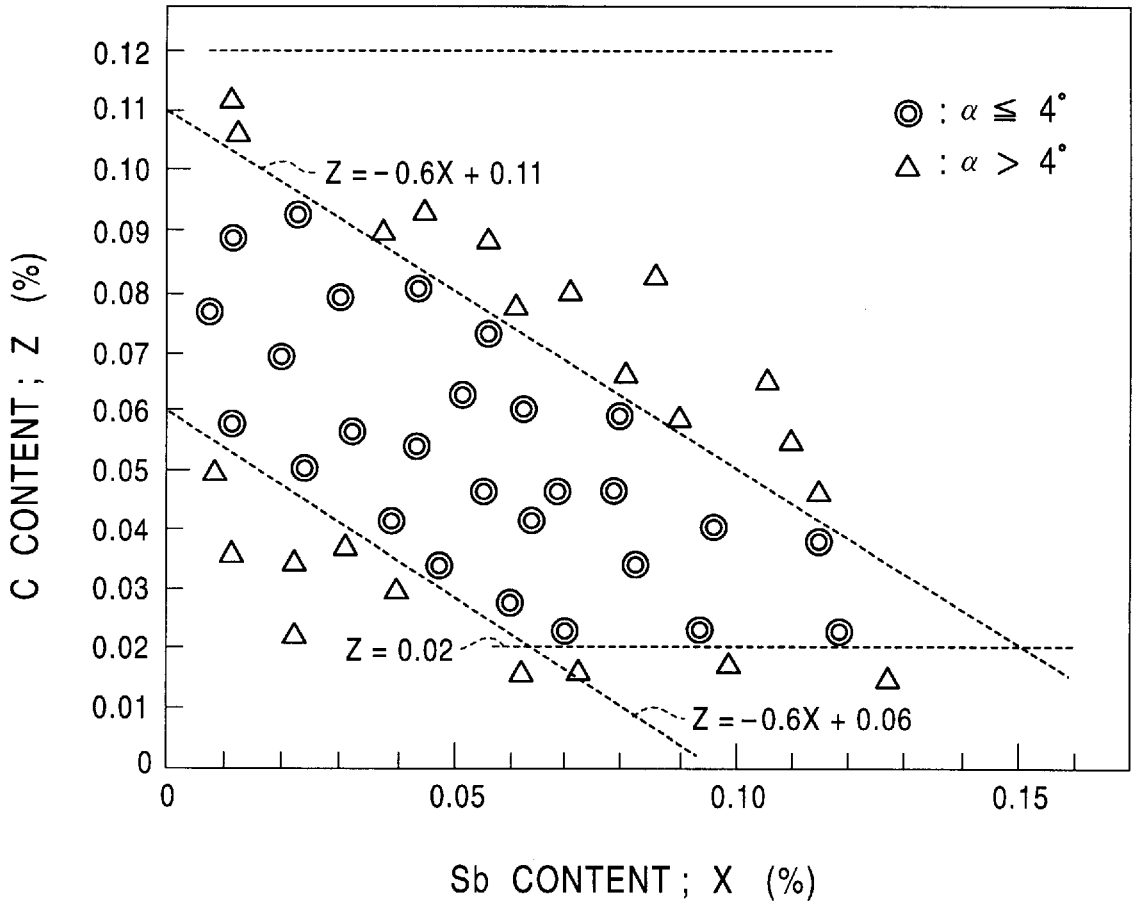
FIG. 2 is a drawing showing the influence exerted by Sb content and C content to an average of sheet facial rotation angle from the (110) [001] orientation in the grain orientation of secondary recrystallized grains contained in the products.

Measured for α were the products produced on the same production conditions as those of A-2 or F-2 in Experiment 1 using various slabs obtained by changing the C and Sb contents and adjusting the others to almost the same composition of the slab marked by A in Table 4. The results are shown in FIG. 2. The products of $\alpha \leqq 4°$ were shown by ⊙, and those of $\alpha > 4°$ were shown by Δ, wherein the abscissa was allotted to the Sb content (wt %), and the ordinate was allotted to the C content (wt %). It is confirmed that an area surrounded by $0.02 \leqq Z$, $-0.6X+0.06 \leqq Z \leqq -0.06X+0.11$ and $Z \leqq 0.10$ is an appropriate area, wherein Z (wt %) represents the C content, and X (wt %) represents the Sb content.

The addition of Ni accelerates forsterite film formation in final annealing and therefore allows a uniform and good film to be formed. Further, purification of Al, S, Se and N from the steel is promoted. Inversely, however, Ti becomes likely to enter into the steel. Accordingly, specific attention has to be paid to controlling the atmosphere in purification at high temperatures in final annealing. Experiment 2 which follows was carried out in order to establish optimum conditions for controlling the atmosphere in purification at high temperatures.

Experiment 2:

Eight grain oriented electrical steel sheets with a thickness of 250 mm having compositions shown by the mark A in Table 4 were heated to 1390° C. to prepare hot rolled coils having a thickness of 2.2 mm by hot rolling. The hot rolling was finished at a steel sheet temperature of 1000° C. After finishing the hot rolling, a large amount of cooling water was sprayed on the surfaces of the steel sheets to cool them at a rate of 50° C./second, and the steel sheets were coiled at a steel sheet temperature of 550° C. The above hot rolled steel sheets were subjected to hot rolled sheet annealing in which the steel sheets were heated at a heating rate of 15° C./second between 700 to 900° C. to heat them up to a steel sheet temperature of 1000° C. and held at the same temperature for 30 seconds. After finishing the hot rolled sheet annealing, the above steel sheets were pickled and rolled to a thickness of 1.8 mm by cold rolling, followed by subjecting them to intermediate annealing in which the steel sheets were held at a steel sheet temperature of 1100° C. for 50 seconds in a mixed atmosphere having a dew point of 50° C. and 50% $N_2$+50% $H_2$. After pickling the above steel sheets they were cold rolled to a final thickness of 0.22 mm at a steel sheet temperature of 220° C. Grooves having a width of 100 $\mu$m and a depth of 20 $\mu$m were formed on the surfaces of the steel sheets subjected to degreasing treatment in a direction perpendicular to the rolling direction at an interval of 5 mm in the rolling direction. After finishing groove-forming treatment, the steel sheets were subjected to decarburization annealing at a steel sheet temperature of 850° C. for 2 minutes. An annealing separator comprising MgO containing 10% of $TiO_2$ was applied on the surfaces of the above steel sheets, and the steel sheets were wound up in the form of a coil. After winding up, the coils were subjected to final annealing. In the final annealing, the heating rate was set to 30° C./h up to 800° C. and 12° C./h at 800° C. or higher, and the steel sheets were heated up to 1200° C. and kept for purification at the same temperature for 5 hours. Then, the above steel sheets were subjected to controlled cooling treatment up to 800° C. and natural cooling treatment at 800° C. or lower. The respective atmospheric conditions from heating from 500° C. up to the completion of the purification are shown in Table 2. The atmosphere was 100% $N_2$ at room temperatures to 500° C., 100% $H_2$ from the completion of the purification to 800° C. and 100% $N_2$ at 800° C. or lower. After final annealing, the unreacted annealing separator was removed from the surfaces of the steel sheets. After removing, a coating liquid comprising 50% of colloidal silica and 50% of magnesium phosphate was applied, and the steel sheets were subjected to baking to provide them with a tension coating, whereby the products were prepared.

Test pieces of an epstein size (280L×30W) cut out of the respective products along the rolling direction were subjected to stress relief treatment at 800° C. for 3 hours, and then the iron loss values ($W_{17/50}$) in a magnetic flux density of 1.7 T and the magnetic flux densities ($B_8$) in a magnetic field of 800 A/m were measured. Further, the steel sheets were subjected to macro etching to determine the two-dimensional crystal grain distributions on the surfaces of the steel sheets and the sheet facial rotation angle averages ($\alpha$) of the crystal grains from the (110) [001] orientation in the crystal grain orientations. Further, the product sheet compositions were analyzed. The two-dimensional crystal grain diameter was determined by a circle-equivalent diameter. The crystal grain distribution was shown by an area proportion of each crystal grain diameter. Further, the crystal grain orientations were measured (excluding the abnormal values in the intergranular parts) in a face of 300 mm square at a pitch of 2.5 mm to determine $\alpha$ by averaging the sheet face rotation angles. The above results are shown in Table 3 together with the iron loss characteristics.

As shown in Table 3, $W_{17/50}$ was as good as 0.64 to 0.67 W/kg in A-5, A-6, A-7 and A-8. In all cases, the area proportion in a crystal grain diameter of 10 mm or more was 93% or more, and the area proportion in a crystal grain diameter of 2 mm or less was 4% or more. Further, the $\alpha$ value was 3 degrees or less in all cases. According to Table 2, A-5, A-6, A-7 and A-8 were subjected to final annealing in a high temperature range of 900° C. or higher in a mixed atmosphere of $N_2$ and $H_2$.

$W_{17/50}$ was as inadequate as 0.83 to 0.86 W/kg in A-3 and A-4. The area proportion in a crystal grain diameter of 2 to 10 mm was 75% or less, and the area proportion in a crystal grain diameter of 2 mm or less was 2% or less. The area proportion in a crystal grain diameter of 2 to 10 mm was as high as 25% or more. Further, the $\alpha$ value was 5 degrees or more. According to Table 2, it was not until the temperature exceeded 1000° C. that A-3 and A-4 were subjected to annealing in the atmosphere containing $H_2$.

$W_{17/50}$ was as inferior as 0.78 to 0.82 W/kg in A-9 and A-10. However, the area proportion in a crystal grain diameter of 2 to 10 mm was 95% or more, and the area proportion in a crystal grain diameter of 2 mm or less was 3.8% or more. Further, the $\alpha$ value was 3 degrees or less. However, Ti contained in the steels was 30 ppm or more and high as compared with those of A-5, A-6, A-7 and A-8. According to Table 2, A-9 and A-10 were subjected to annealing in the atmosphere containing $N_2$ only in a low temperature range of lower than 1000° C.

A-3 and A-4 which were the products subjected to annealing in the atmosphere containing $H_2$ at temperatures exceeding 900° C. increased in crystal grains having a size of 2 to 10 mm and increased as well in a sheet facial rotation angle $\alpha$ in the grain orientations. It is assumed that since heat treatment was carried out at low temperatures in the atmosphere containing only $N_2$, the primary recrystallized grains on the surfaces of the steel sheets were possibly inhibited from growing, and as a result thereof, the secondary recrystallized grains with a size of 2 to 10 mm having inferior orientations were formed. In order to prevent the secondary recrystallized grains with a size of 2 to 10 mm having inferior directions from being formed, $H_2$ has to be present in the atmosphere at least from about 900° C. upon heating in final annealing.

The products A-9 and A-10 were deteriorated in iron loss while Ti of about 30 ppm or more was present in the steels and the sizes and the orientations of the secondary recrystallized grains were good. It is assumed that since annealing was carried out in the atmosphere containing $N_2$ only in a low temperature range of lower than about 1000° C., Ti penetrated in a high temperature range. $N_2$ gas acts to lower the activity of Ti to inhibit it from penetrating into a steel. If $N_2$ gas is allowed to be contained in the atmosphere when the diffusion of Ti into a steel is activated particularly in a high temperature range, Ti can very effectively be inhibited from penetrating into the steel. That is, $N_2$ has to be contained in the atmosphere at least up to about 1000° C. in order to inhibit Ti from penetrating into the steel.

Accordingly, at a heating step in final finishing annealing, $H_2$ has to be present in the atmosphere at least from about 900° C., and $N_2$ has to be present at least up to about 1000° C. in order to obtain good iron loss.

Precipitation behavior of BN is almost the same as that of AlN. Accordingly, the results of Experiments 1 and 2 in which a principal inhibitor is AlN alone can be applied, as it is, to the case of a mixture of AlN and BN and the case of BN alone.

Other effective methods for reducing iron loss include use of magnetic domain-refining treatment. Out of magnetic domain-refining treatments, a method in which the surface of a steel sheet is irradiated with a laser or plasma jet is well known and can be applied as well to the present invention. Out of other magnetic domain-refining treatments, one can use a method in which grooves are provided on the surface of a steel sheet, and this does not cause the iron loss reduction effect to be lost even if the steel sheet is subjected to stress relief annealing, and therefore it can become a more effective method. In the method in which grooves are provided, it is particularly effective for reducing iron loss to provide grooves having a width of about 50 to 1000 μm and a depth of about 10 to 50 μm on the surface of a steel sheet in a direction crossing the rolling direction. With respect to methods other than the magnetic domain-refining treatment, it has so far been known to subject the surface of a steel sheet to mirror face treatment and crystal orientation-intensifying treatment, and is effective for reducing iron loss. The crystal orientation-intensifying treatment means treatment for causing crystal faces to be exposed which are more advantageous in terms of magnetic characteristics. In mirror face treatment and crystal orientation-intensifying treatment, the forsterite film usually formed on the surface of a steel sheet is not present, and therefore coating with bonding material like plating or direct finish coating is provided. Further, the magnetic domain-refining treatment, the mirror face treatment and the crystal orientation-intensifying treatment are not prevented from being used in combination, respectively.

In order to obtain with more certainty the grain oriented electrical steel sheet of the present invention, it is effective to provide a surface desiliconized layer-forming treatment at an annealing step after hot rolling and to provide atmosphere controlling and quenching treatment in annealing before final cold rolling. The surface desiliconized layer-forming treatment accelerates the growth of the primary recrystallized grains on the surface of the steel sheet in final annealing. It is effective for inhibiting production of secondary recrystallized grains having inferior orientations to accelerate the growth of the surface primary recrystallized grains. The surface desiliconized layer is formed preferably in a thickness of about 0.5 μm or more. The atmosphere controlling forms a decarburized layer on the surface of the steel sheet. It is effective for accelerating the formation of nuclei for the crystal grains having excellent orientation on the surface of the steel sheet to form the decarburized layer on the surface of the steel sheet. In particular, the decarburized layer having a thickness of 1/20 to 1/5 of sheet thickness is preferably formed on the surface of the steel sheet. The quenching treatment gives solid solute C enrichment. The solid solute C enrichment is effective for raising the nucleus-forming frequency of secondary recrystallized grains that have good orientations. In order to make this more effective, fine carbide is preferably precipitated by maintaining the steel at low temperatures after quenching treatment.

Further, it is effective for enhancing the practical characteristics of a transformer to control the area proportion of fine grains of about 2 mm or less contained in the product to a fixed value or lower and increase the number proportion. Accordingly, it is preferably used in combination in the present invention. It is particularly recommended to control the proportion (by numbers) to 70% or more.

It is possible according to the present invention to use a slab having a low nitrogen concentration in the steel to carry out nitriding treatment at an annealing step after hot rolling.

Turning now to structural requisites of the grain oriented electrical steel sheet of the present invention, it is composed of many secondary recrystallized grains having an excellent alignment degree. In order to reduce hysteresis loss, an area mean α of the rotation angles of the grains from the (110) [001] orientation in the sheet facial orientations has to fall within about 4 degrees. When the α exceeds about 4 degrees, an increase of hysteresis loss brings about degradation of iron loss.

Further, in a grain size distribution of the respective crystal grains, the area proportion of the crystal grains having a diameter of about 10 mm or more has to be about 75% or more, wherein the diameter of the crystal grain corresponds to that of a circle having the same area as the projected area of the crystal grain. The average grain diameter of the whole crystal grains has to be about 25 mm or less. That is, the crystal grains having a double-peak distribution in which coarse grains and fine grains increase result in stably providing good magnetic characteristics. When crystal grains having a diameter of about 10 mm or more have an area proportion of less than about 75%, the proportion of secondary recrystallized grains having good orientations is lowered, and this brings about a deterioration of iron loss. When the average grain diameter exceeds about 25 mm, the number of fine crystal grains of about 2 mm or less decreases, and stability in secondary recrystallization is damaged, so that deterioration of iron loss is caused as well.

An excess increase of area proportion of the fine grains of about 2 mm or less is not preferred in relationship to the iron loss characteristic. However, the high number ratio of the fine grains of about 2 mm or less raises the practical characteristics of a transformer. Allowing the fine grains to raise the practical characteristics of a transformer originates in the effect of the grain boundary. Accordingly, the fine gains produced in the grain boundary of the coarse grains are less effective. It is particularly effective to cause the fine grains to be present in the inside of the coarse grains. An artificial disposition of the fine grains is preferred for causing the fine grains to be present in the inside of the coarse grains. In order to dispose artificially the fine grains, treatment that adds local energy, such as heat or distortion before or after or in a middle stage of primary recrystallization, is suitably carried out.

Turning now to important components of the steel composition:

Si raises the electrical resistance and therefore is a component required for reducing the eddy current loss of the steel sheet. It has to be present in a content of about 1.5 wt % (hereinafter shown merely by [%]) or more. However, when the content exceeds about 7.0%, cold rolling processing becomes difficult, and therefore the content falls in a range of about 1.5 to 7.0%.

Mn, Cu, Sn, Ge, Bi, V, Nb, Cr, Te, Mo and P are inhibitor auxiliary components alone or in combination of two or more species thereof. The content of these components falls in a range of about 0.005 to 2.5% in terms of a single amount or a total amount of two or more species. If the content is less than 0.005%, the auxiliary inhibiting effect is reduced, so that improvement action of the magnetic characteristics is lowered. If the content exceeds about 2.5%, the auxiliary inhibiting effect is excessive, and the secondary recrystallization orientation is reduced, so that the magnetic characteristics are rather deteriorated. P raises hardness of the steel sheet to deteriorate rolling workability, and therefore its upper limit is controlled particularly to about 0.30 wt %.

Sb is an important component of the present invention. Sb is segregated in a grain boundary in the steel and serves to inhibit normal grains from growing. This inhibition results in coarsening the crystal grains of the product and raising the orientation alignment degree. In order to obtain this action, Sb has to be present in a content of about 0.005% or more, but when the content exceeds about 0.15%, decarburization becomes extremely difficult, and therefore it falls in a range of about 0.005 to 0.15%.

Ni is one of the components characteristic of the present invention. Ni is a component for homogenizing the grain structure during hot rolling, raising the alignment degree in the orientations of the secondary recrystallized grains, bringing about a double-peak distribution in which coarse grains and fine grains contained in the secondary recrystallized grains increase at the same time, stabilizing the iron loss. In order to obtain this action, Ni has to be present in the steel in a content of at least about 0.02% or more. The content of about 0.02% or more accelerates purification and forsterite film formation in final annealing. Homogenization of the grain structure during hot rolling is made via γ transformation during hot rolling, and therefore the minimum value and the maximum value of the Ni content (Y %) have to be increased according to the Sb content (X %). If the Ni content is excessive, a γ phase is partially formed in a secondary recrystallized nucleus-forming position on the surface of the steel sheet, and therefore the adverse effect that the secondary recrystallized nucleus-forming frequency is lowered and secondary recrystallization becomes difficult. Accordingly, the Ni content (Y) falls preferably in a range of about $5(X-0.05) \leqq Y \leqq 10 \times X$ (X: Sb content), and the upper limit thereof is about 1.0%.

Further, B can be present as well in the steel sheet of the present invention. B is contained as an inhibitor element in place of Al, and, what is more is a component making it easy to form fine grains, and therefore the fine grain frequency can be controlled by suitably adding it. For these purposes, B is present preferably in a range of about 0.0050% or less. The lower limit of more preferred range is about 0.0003%.

All of C, Ti, S, Se, O and Al, which are impurities contained in the steel sheet, are present in the steel of the finished product to increase the hysteresis loss and therefore have to be reduced. That is, C and Ti have to be reduced to about 0.003% or less respectively, S and Se to about 0.003% or less in total and O and Al to about 0.002% or less respectively.

Next, the surface of the steel sheet may be in a condition in which the surface of the ground steel is covered with a normal forsterite film and a known tension coating is provided thereon or a condition in which the surface of the base steel is subjected to mirror face treatment and a tension coating is provided thereon. Further, the surface of the base steel may be subjected to crystal orientation-intensifying treatment such as NaCl electrolysis and then to tension coating directly or indirectly with bonding material like plating therebetween. The crystal orientation-intensifying treatment such as NaCl electrolysis carries out selection treatment of treatment-grain orientation for causing (110) [001] orientation grains to remain selectively to obtain a condition in which grain orientations advantageous for the magnetic characteristics are intensified. The selection of the grain orientations is a means for displaying better the tension effect provided by coating on the surface of the steel sheet.

Further, grooves for refined magnetic domains may be provided on the surface of the steel sheet. Grooves having a width of about 50 to 1000 μm and a depth of about 10 to 50 μm are preferably present in a direction crossing with the rolling direction. Grooves deviating from this condition reduce the magnetic domain-refining effect and decrease the iron loss-improving effect. Magnetic domain refinement by the grooves does not have the same iron loss reduction mechanism as that of the mirror face treatment or the grain orientation-intensifying treatment each described previously. Accordingly, the use thereof in combination is a preferred means for obtaining the low iron loss.

Further, as another means for magnetic domain refinement, it is possible as well to form locally fine strain in the inside of the steel sheet by irradiation with a laser or plasma jet.

Next, the production process for the grain oriented electrical steel sheet in the present invention shall be described.

First, the composition ranges of the slabs which are the starting materials are as follows.

C accelerates γ transformation in hot rolling and improves the hot rolled structure and therefore is required for carrying out good secondary recrystallization. For this purpose, C has to be present in a content of about 0.02% or more. However, if the content exceeds about 0.1%, decarburization in the middle of the production process becomes difficult, and therefore the content falls in a range of about 0.02 to 0.10%.

Si is an essential component for increasing the electrical resistance and reducing the iron loss. For these purposes, Si has to be contained in a content of about 1.5% or more. However, if the content exceeds about 7.0%, the product becomes fragile, deteriorating processability. Accordingly, the content of Si falls in a range of about 1.5 to 7.0%.

Further, an inhibitor component for inducing secondary recrystallization has to be present in the steel. Al and/or B and N are inhibitor principal components.

Al has to be present in a content of about 0.010 to 0.040% If the content of Al is less than about 0.010%, the amount of AlN precipitated in a heating step in hot rolled sheet annealing is reduced, and therefore the inhibitor function is not displayed. If the content exceeds about 0.040%, the inhibitor compositely precipitated is coarsened to deteriorate the inhibiting effect. Accordingly, the content of Al is set to about 0.010 to 0.040%.

N is contained in the slab sufficiently in a content exceeding about 0.0100% since a sufficient AlN amount can be secured by nitriding the steel sheet at an annealing step on the way. However, when the content exceeds 0.0100%, blister defect is caused in the middle of hot rolling in a certain case. Accordingly, the content of N is set to about 0.0010 to 0.0100%.

S or Se is necessary for finely precipitating MnS, MnSe and $Cu_2Se$ compositely with AlN. For this purpose, S or Se has to be contained in a content about 0.005% or more alone or in combination. However, if the content exceeds about 0.025%, the precipitate is coarsened. Accordingly, the content falls in a range of about 0.005 to 0.025%.

It is one of the characteristics of the present invention to cause Sb to be further present as an inhibitor. Sb is segregated in grain boundaries to function as an inhibitor. For this purpose, Sb has to be present in a content of about 0.005% or more. However, if the content exceeds about 0.15%, decarburization in decarburization annealing becomes unsatisfactory. Accordingly, the content of Sb is set to about 0.005 to 0.15%.

At least one of Mn, Cu, Sn, Ge, Bi, V, Nb, Cr, Te, Mo and P have to be present as an inhibitor auxiliary component in a content of about 0.005 to 2.5 wt % in terms of a single amount or a total amount of two or more species. These components form precipitates and are segregated in an intergranular interface or an interface of the precipitates. As a result thereof, they have an auxiliary function for enhancing inhibiting effect. Further, Mn and Cu act to raise the electrical resistance and therefore have the effect of reducing directly the iron loss. In order to provide the inhibitor auxiliary action, at least one of Mn, Cu, Sn, Ge, Bi, V, Nb, Cr, Te, Mo and P have to be present in a content of about 0.005% or more expressed as a single amount or a total amount of two or more kinds thereof. However, if the content exceeds about 2.5%, embrittlement and inferior decarburization of the steel sheet are brought about. Accordingly, they are contained in a range of about 0.005 to 2.5%. P raises the hardness of the steel sheet and deteriorates it rolling properties, and therefore the upper limit is set particularly to about 0.30 wt %.

B can be present as well. B is effective for producing fine grains and has to be present in a content of about 0.0003% or more. Further, in this case, BN functions as an inhibitor in place of AlN, and therefore the content of Al can be less than about 0.010%. When the content of B is less than about 0.0003 wt %, the amount of BN precipitated in a heating step in hot rolled sheet annealing is reduced, and therefore the inhibitor function is not provided. When the B content exceeds about 0.040 wt %, the inhibitor compositely precipitated is coarsened, and inhibiting effect deteriorates. Accordingly, the content of B is set to about 0.0003 to 0.040 wt %.

In addition to the above, it is an important requisite in the present invention to control the Ni content (Y %) and the C content (Z %) particularly according to the Sb content (X %).

The content of Ni falls suitably in a range of about $5(X-0.05) \leqq Y \leqq 10X$. If the Ni content is less than the lower limit, improvement of hot rolled structure degrades due to the Sb ("X") contained therein not being sufficient to be effective. If the Ni content is more than the upper limit (10"X"), the nucleus-forming frequency of the secondary recrystallized grains on the surface of the steel sheet is lowered, deteriorating the iron loss.

Further, the content of C falls suitably in a range of about $-0.6X+0.06 \leqq Z \leqq -0.6X+0.11$. If the C content is less than the lower limit, improvement of hot rolled structure by γ transformation in hot rolling is not sufficient. If the C content is more than the upper limit, the nucleus-forming frequency of the secondary recrystallized grains on the surface of the steel sheet is lowered and this deteriorates the iron loss.

The steel slab prepared in such composition is heated to about 1300° C. or higher and subjected to hot rolling to prepare a hot rolled coil. The hot rolled coil is subjected to cold rolling once or twice or more, interposing intermediate annealing to prepare a cold rolled coil having a final sheet thickness. The cold rolled coil is subjected to decarburization annealing and final annealing following it and then to coating•flatening annealing to obtain the product.

Regarding other controls, the outlet temperature of hot rolling has to be controlled to about 900 to 1150° C. If the outlet temperature of hot rolling is lower than about 900° C., AlN and/or BN is precipitated alone during hot rolling, and therefore the composite fine precipitates can not be obtained. This causes the desired strong inhibiting effect to be lost and deteriorates the iron loss. If the outlet temperature of hot rolling exceeds about 1150° C., sulfide and selenide are coarsely precipitated during hot rolling. This reduces the inhibiting effect of the inhibitor and deteriorates the iron loss. Accordingly, the outlet temperature of hot rolling is controlled to about 900 to 1150° C. The hot rolled sheet is preferably quenched and coiled at low temperatures. That is to prevent AlN and/or BN from coarsely precipitating in hot rolling. The hot rolled coil is subjected to cold rolling once or twice or more, while interposing intermediate annealing to prepare a cold rolled coil having a final sheet thickness. Usually, the hot rolled steel sheet is subjected to hot rolled sheet annealing before the first cold rolling in order to improve the hot rolled structure. However, the present invention can be applied as well to a process having no hot rolled sheet annealing.

In annealing over the temperature of 900° C. carried out first after hot rolling, the heating rate at about 700 to 900° C. is set to about 2 to 30° C./second. The annealing over the temperature of 900° C. provided first after hot rolling means hot rolled sheet annealing when hot rolled sheet annealing over the temperature of 900° C. is carried out. If intermediate annealing is carried out after the first cold rolling without carrying out hot rolled sheet annealing or hot rolled sheet annealing under the temperature of 900° C. is carried out, this intermediate annealing is meant. AlN and/or BN staying in a saturated solute solution condition has to be compositely precipitated with fine sulfides and selenides as precipitation nuclei in a heating step in annealing carried out first after hot rolling. It is important here to obtain fine composite precipitates. The heating rate has to be strictly controlled in a heating step in annealing in order to obtain the desired fine composite precipitates. If the heating rate exceeds about 30° C./second, the composite precipitates are coarsened, and the inhibiting effect is lowered, so that the iron loss is deteriorated. If the heating rate is lower than about 2° C./second, the recovered structures tend to remain or the grain diameters tend to be coarsened, so that improvement of the hot rolled structure is not obtained. Accordingly, the heating rate is controlled to about 2 to 30° C./second.

In cold rolling, known interpass aging and warm rolling are advantageously applied. Further, in annealing immediately before final cold rolling, quenching is preferably carried out in cooling. Quenching increases solid solute C contained in the steel and therefore raises the nucleus-forming frequency in secondary recrystallization. Quenching and then holding at low temperatures accelerate precipitation of fine carbide in the steel and raise the nucleus-forming frequency in secondary recrystallization, and therefore are preferred.

The cold rolled sheet having a final sheet thickness is subjected to decarburization annealing. Treatment for providing grooves on the surface of the steel sheet can be carried out as well. Grooving treatment refines the magnetic domains of the product and reduces the iron loss. Further, dotwise local heat treatment and chemical treatment can artificially be carried out as well from the stage that begins after final cold rolling, up to the stage before secondary recrystallization. Fine crystal grains are produced in the product sheet, the magnetic domains in the product are refined and the iron loss is reduced.

The steel sheet is subjected to degreasing after final cold rolling and then to decarburization annealing. After decarburization annealing, an annealing separator is applied on the surface of the steel sheet, and the steel sheet is rolled up in the form of coil and subjected to final annealing. Known various annealing separators can be selected depending on whether or not a forsterite film is formed on the surface of the steel sheet. That is, if a forsterite film is formed on the surface of the steel sheet, an annealing separator comprising MgO as a principal component is used. If the surface of the steel sheet is subjected to mirror face treatment, an $Al_2O_3$ base annealing separator is used in many cases. Other known annealing separators can be applied as well.

The atmosphere in heating has to be controlled at a final annealing step. $H_2$ has to be contained in the atmosphere at least from about 900° C. In heating in the final annealing, $H_2$ gas acts to grow crystal grains on the surface of the steel sheet. This inhibits the secondary recrystallized grains with a size of about 2 to 10 mm having inferior orientations from growing, raising the orientation alignmnet degree and therefore reducing iron loss. $H_2$ has to be present in the atmosphere at least from about 900° C. in order to cause the crystal grains on the surface of the steel sheet to grow. $H_2$ gas also acts to remove impurities such as S, Se and N contained in the steel.

Further, $N_2$ has to be present at least up to about 1000° C. in heating in final annealing. $N_2$ gas lowers the activity of N on the surface of the steel sheet in heating in final annealing. This inhibits Ti from penetrating into the steel and therefore raises the iron loss of the product. $N_2$ has to be present in the atmosphere at least up to 1000° C. in order to reduce the activity of N on the surface of the steel sheet. If $N_2$ is not present in the atmosphere from a temperature range of lower than about 1000° C. in heating, Ti penetrates into the steel to deteriorate the iron loss.

After final annealing, the unreacted annealing separator on the surface of the steel sheet is removed. After removing, insulating coating is carried out if necessary, and then flattening annealing is further carried out to prepare the product. It is preferable for improving the iron loss to carry out tension coating as the insulating coating. The product sheet can be subjected to known magnetic domain-refining treatments to reduce the iron loss. The known magnetic domain-refining treatments include linear irradiation with plasma jet and laser and treatment for providing a linear concave area with a projected roll. Further, when a film is not formed in final annealing, most preferable for reducing the iron loss is a method in which the steel sheet is further subjected to mirror face treatment or to tension coating after subjecting it to crystal orientation-intensifying treatment to prepare the product.

EXAMPLES

The following Examples have been selected to show specific ways of carrying out the invention. They are not intended to define or to limit the invention, which is defined in the appended claims.

Example 1

Steel slabs having compositions shown by marks A to T in Table 4 were heated to 1420° C. and then turned into sheet bars having a thickness of 45 mm by rough hot rolling. The outlet temperature of rough hot rolling was set to 1230° C. The above sheet bars were turned into hot rolled steel sheets having a sheet thickness of 2.2 mm by finish hot rolling. The outlet temperature of finish hot rolling was set to 1020° C. The above hot rolled steel sheets were sprayed on the surfaces thereof with cooling water to cool to 600° C. and wound up in the form of a coil.

The above hot rolled steel sheets were heated up to 1100° C. at a heating rate of 15.5° C./second and subjected to hot rolled sheet annealing for a soaking time of 30 seconds. The heating rate between 700 to 900° C. was set to 11.5° C./second. After hot rolled sheet annealing, the above annealed sheets were pickled and cold-rolled to a thickness of 1.5 mm. After cold rolling, the above cold rolled sheets were subjected to intermediate annealing in which the steel sheets were held at 1080° C. for 50 seconds in an $H_2$ atmosphere of a dew point of 40° C. The C content was reduced by about 0.01% in the intermediate annealing. Further, in the intermediate annealing, quenching treatment at 30° C./second was carried out by spraying with water mist in order to increase solid solute C. After intermediate annealing, warm rolling at a steel sheet temperature of 220° C. was carried out to obtain a final sheet thickness of 0.22 mm. Degreasing treatment was carried out after warm rolling. Grooves having a depth of 20 $\mu$m and a width of 150 $\mu$m were introduced in a direction at an angle of 75 degrees to the rolling direction at an interval of 4 mm in the rolling direction, and then decarburization annealing at 850° C. for 2 minutes was carried out. An annealing separator prepared by adding 5% of $TiO_2$ to MgO was applied on the decarburization annealed sheets, and the sheets were subjected to final annealing. In the final annealing, the heating rate was set to 30° C./h up to 800° C., 12.5° C./h at 800 to 1050° C. and 25° C./h at 1050 to 1150° C. Annealing atmospheric gases in heating were 100% $N_2$ up to 800° C., a mixture of 25% $N_2$ and 75% $H_2$ at 800 to 1050° C. and 100% $H_2$ at 1050 to 1150° C. After heating up to 1150° C., the above steel sheets were subjected to purification treatment at the same temperature for 6 hours in the 100% $H_2$ gas atmosphere. After finishing the purification treatment, the above steel sheets were cooled in the $H_2$ gas atmosphere down to a steel sheet temperature of 600° C. and in the $N_2$ gas atmosphere at a steel sheet temperature of 600° C. or lower. After the final annealing, the unreacted annealing separator was removed from the surface of the steel sheets. After removing, a coating liquid comprising 50% of colloidal silica and 50% of magnesium phosphate was applied, and the steel sheets were subjected to baking treatment at 800° C. to provide them with a tension coating, whereby the products were prepared. The characteristics of these products are shown in Table 5. The steel analytical values of the products were determined by a wet chemical analytical method.

As shown in Table 5, the grain oriented electrical steel sheets falling in the composition range of the present invention and having average grain diameters, crystal grain distributions, orientation alignment degrees and impurity contents according to the present invention have very excellent iron losses.

Example 2

Seven steel slabs having a composition shown by a mark I in Table 4 were heated to 1430° C. and then turned into hot rolled coils having a thickness of 2.6 mm by hot rolling. The outlet temperatures of finish hot rolling were set to 850° C. (mark a), 880° C. (mark b), 920° C. (mark c), 1000° C. (mark d), 1090° C. (mark e), 1140° C. (mark f) and 1170° C. (mark g). After finishing the hot rolling, a large amount of coil cooling water was sprayed on the surfaces of the steel sheets to cool them at a rate of 50° C./second, and the steel sheets were coiled at a steel sheet temperature of 550° C. These seven kinds of hot rolled coils were subjected to hot rolled sheet annealing in which the coils were heated at a heating rate of 12° C./second up to a steel sheet temperature of 1000° C. and held at the same temperature for 30 seconds. The heating rate between 700 to 900° C. was set to 10.6° C./second. After hot rolled sheet annealing, the above steel sheets were pickled and rolled to a thickness of 1.9 mm by cold rolling. After cold rolling, the above cold rolled sheets were subjected to intermediate annealing in which the steel sheets were held at 1100° C. for 50 seconds in a mixed atmosphere of a dew point of 50° C. and 50% $N_2$ and 50% $H_2$. After subjecting the annealed steel sheets to pickling treatment, they were subjected to warm rolling at a steel sheet temperature of 220° C. to obtain a final thickness of 0.26 mm. After warm rolling, degreasing was carried out, and grooves having a width of 100 $\mu$m and a depth of 20 $\mu$m were formed on the surface of the steel sheet in a direction perpendicular to the rolling direction at an interval of 5 mm in the rolling direction. After groove-forming treatment, decarburization annealing at 850° C. for 2 minutes was carried out. After decarburization annealing, mixed powder comprising 3% of $Sb_2O_3$, 3% of CaO, 25% of $Al_2O_3$ and 40% of MgO was applied as an annealing separator on the surfaces of the steel sheets, and the steel sheets were wound up in the form of a coil and subjected to final annealing. $Sb_2O_3$ was added for inhibiting coating formation. In the final finishing annealing, the heating rate was set to 30° C./h up to 800° C., 15° C./h at 800 to 1050° C. and 20° C./h at 1050 to 1200° C. Annealing atmospheric gases in heating were 100% $N_2$ up to 800° C., a mixture of 25% $N_2$ and 75% $H_2$ at 800 to 1050° C. and 100% $H_2$ at 1050 to 1200° C. After heating up to 1200° C., the above steel sheets were subjected to purification treatment at the same temperature for 5 hours in the 100% $H_2$ gas atmosphere. After finishing the purification treatment, the above steel sheets were controlled cooled in the $H_2$ gas atmosphere down to a steel sheet temperature of 800° C. and cooled in the $N_2$ gas atmosphere at a steel sheet temperature of 800° C. or lower. After the final annealing, the unreacted annealing separator was removed from the surfaces of the steel sheets, and then the surfaces of the steel sheets were subjected to NaCl electrolytic treatment. The NaCl electrolytic treatment selects the grain orientations on the surfaces of the steel sheets to intensify the (110) face orientation. After the electrolytic treatment, a two-layer tension coating comprising aluminum phosphate as a coating lower part and 50% of colloidal silica and magnesium phosphate as a coating upper part was provided to prepare the products. Test pieces of an epstein size (280L×30W) cut out of the respective products along the rolling direction were subjected to stress relief treatment at 800° C. for 3 hours, and then the iron loss values ($W_{17/50}$) in a magnetic flux density of 1.7 T and the magnetic flux densities ($B_8$) in a magnetic field of 800 A/m were measured. Further, the steel sheets were subjected to macro etching to determine the two-dimensional crystal grain distributions on the surfaces of the steel sheets and the sheet facial rotation angle averages ($\alpha$) of the crystal grains from the (110) [001] orientation in the crystal grain orientations. Further, the product sheet compositions were analyzed. The two-dimensional crystal rain diameter was determined by a circle-equivalent diameter. The crystal grain distribution was shown by an area proportion of each crystal grain diameter. Further, the crystal grain orientations were measured (excluding the abnormal values in the intergranular parts) in a face of 300 mm square at a pitch of 2.5 mm to determine the $\alpha$ by averaging the sheet face rotation angles. These results are shown in Table 6 together with the iron loss characteristics.

As shown in Table 6, the grain oriented electrical steel sheets falling in the composition range of the present invention and having average grain diameters, crystal grain distributions, orientation alignment degrees and impurity contents according to the present invention had very excellent iron losses.

Example 3

Four steel slabs containing 0.058% of C, 3.45% of Si, 0.07% of Mn, 0.025% of Al, 0.08% of P, 0.015% of S, 0.058% of Sb, 0.25% of Ni, 0.0010% of B and 0.0075% of N and comprising the remainder of Fe and inevitable impurities were heated to 1390° C. and then turned into sheet bars having a thickness of 35 mm by rough hot rolling. The above sheet bars were turned into hot rolled steel sheets having a sheet thickness of 1.8 mm by finish hot rolling. The outlet temperature of finish hot rolling was set to 960° C. The above hot rolled steel sheets were sprayed on the surfaces thereof with jet water to quench them to 570° C. at a cooling rate of 50° C./second and wound up in the form of a coil. The above hot rolled steel sheets were heated up to 1100° C. at heating rates of 3° C./second (mark h), 15° C./second (mark i), 28° C./second (mark j) and 37.5° C./second (mark k) respectively and subjected to hot rolled sheet annealing for a soaking time of 30 seconds. The heating rates between 700 to 900° C. were set to 1.5° C./second of code h, 12.3° C./second of code i, 21.2° C./second of code j and 34.6° C./second of code k. After soaking, the annealed sheets were sprayed with mist water to quench them to 350° C. at a cooling rate of 40° C./second and held at the same temperature for 30 seconds. Holding aims at precipitation of carbide. After hot rolled sheet annealing, the respective steel sheets were subjected to warm rolling to a final sheet thickness of 0.20 mm at fixed temperatures of 150 to 230° C. by means of a Sendzimir mill. After warm rolling, the steel sheets were subjected to degreasing treatment and then to decarburization annealing at 850° C. for 2 minutes. An annealing separator prepared by adding 7.5% of $TiO_2$ and 3% of $SbO_2$ to MgO containing 0.08% of B was applied on the decarburization annealed sheets, and they were wound up in the form of a coil and subjected to final annealing. In the final annealing, the heating rate was set to 30° C./hour up to 850° C. and 15° C./hour at 850 to 1150° C. The steel sheets were kept at 850° C. for 25 hours and at 1150° C. for 5 hours. Annealing atmospheric gases were 100% $N_2$ in heating and keeping up to 850° C. and a mixture of 25% $N_2$ and 75% H2 in heating from 850 to 1050° C. and 100% $H_2$ over 1050° C. After the final finishing annealing, the unreacted annealing separator was removed from the surface of the steel sheets. After removing, tension coating containing 50% of colloidal silica was carried out. After coating treatment, the steel sheets were linearly irradiated on the surfaces thereof with plasma jet at a pitch of 6 mm in a lateral direction to prepare the products, The magnetic characteristics of these products are shown in Table 7.

As shown in Table 7, the products prepared by controlling the heating rates in the prescribed temperature area in heat rolled sheet annealing within the range of the present invention provided very low iron losses.

Example 4

Steel slabs having compositions shown by mark P (invention) and mark E (comparison) in Table 4 were heated respectively to 1390° C. and then turned into hot rolled steel sheets having a sheet thickness of 2.4 mm. The outlet temperature of hot rolling was set to 980° C. The above hot rolled steel sheets were sprayed on the surfaces thereof with a large amount of cooling water to cool them to 620° C. at a cooling rate of 70° C./second and wound up in the form of a coil. The above hot rolled steel sheet coils were preliminarily heated to 400° C. and then quenched. After preliminary heating treatment, the above hot rolled steel sheet coils were subjected to hot rolled sheet annealing. In the hot rolled sheet annealing, the above hot rolled steel sheets were subjected to soaking treatment in which the steel sheets were held at 1020° C. for 30 seconds and then to gas cooling. The heating rate between 700 to 900° C. was set to 12 to 17° C./second. After hot rolled sheet annealing, the above annealed sheets were pickled and cold-rolled to a thickness of 1.7 mm. After cold rolling, the above cold rolled sheets were subjected to intermediate annealing in which the steel sheets were held at 1080° C. for 50 seconds in an atmospheric gas of a dew point of 35° C. and 55% $N_2$ and 45% $H_2$. The intermediate annealing was carried out in a mixed wet gas atmosphere of $N_2$ and $H_2$ for decarburized layer-forming treatment of the steel sheet surface 20 $\mu$m. Further, in the intermediate annealing, quenching treatment at 35° C./second was carried out in the $N_2$ atmosphere by spraying with water mist in order to increase solid solute C. After intermediate annealing, the above annealed sheets were pickled and subjected to warm rolling to obtain a final sheet thickness of 0.20 mm. In the warm rolling, the first pass and the second pass were carried out at a steel sheet temperature of 120° C. or lower, and the third pass was carried out at 15 to 230° C. Degreasing treatment was carried out after warm rolling. Grooves having a depth of 25 μm and a width of 150 μm were formed in a direction at an angle of 85 degrees to the rolling direction at an interval of 3 mm in the rolling direction, and then decarburization annealing was carried out at 850° C. for 2 minutes. A half amount of the decarburization annealed sheet originating in the slab (invention) having a composition shown by mark P in Table 4 was subjected to spot heating with a size of 1 mm at an interval of 25 mm. Spot heating is treatment for forming fine grains. An annealing separator prepared by adding 5% of $TiO_2$ to MgO was applied on the decarburized sheet, and the sheet was wound up in the form of a coil and then subjected to final annealing. In the final annealing, the heating rate was set to 30° C./h up to 850° C. and 12° C./h at 850 to 1150° C. Carried out were holding at 850° C. for 35 hours and purification treatment at 1150° C. for 5 hours, and then the temperature was lowered. Annealing atmospheric gases were 100% $N_2$ in heating and holding up to 850° C., a mixture of 25% $N_2$ and 75% $H_2$ in heating at 850 to 1150° C., 100% $H_2$ in purification at 1150° C. and cooling down to 800° C. and 100% $N_2$ in cooling from 800° C. to 400° C. After final annealing, the unreacted annealing separator was removed from the surfaces of the steel sheets. After removing, a coating liquid comprising as a principal component magnesium phosphate containing 65% of colloidal silica was applied and baked to carry out tension coating, whereby the products were prepared.

Test pieces having a width of 150 mm and a length of 400 mm were cut out of the respective products to measure the magnetic characteristics. Further, the steel sheets were subjected to macro etching to determine the two-dimensional crystal grain distributions on the surfaces of the steel sheets and the sheet facial rotation angle averages (α) of the crystal grains from the (110) [001] orientation in the crystal grain orientations. Further, the product sheet compositions were analyzed. These products were used to produce three-phase transformers of 30 kW, and their iron loss characteristics were determined. The results are shown in Table 8.

As shown in Table 8, the grain oriented electrical steel sheets of the present invention provided excellent iron losses. Further, particularly the products subjected to fine grain-forming treatment provided markedly excellent characteristics as well as characteristics of the transformers.

Example 5

Steel slabs having compositions shown by marks UA to UL in Table 9 were heated respectively to 1400° C. and then subjected to rough hot rolling at 1250° C. to prepare sheet bars having a thickness of 40 mm. Further, they were subjected to finish hot rolling to prepare hot rolled steel sheets having a sheet thickness of 2.2 mm. The outlet temperature of finish hot rolling was set to 1020° C. The above hot rolled steel sheets were sprayed on the surfaces thereof with cooling water to cool to a steel sheet temperature of 600° C. and wound up in the form of a coil. The above hot rolled steel sheet coils were subjected to hot rolled sheet annealing. In the hot rolled sheet annealing, the hot rolled steel sheets were subjected to soaking treatment in which the steel sheets were held at 1000° C. for 40 seconds and then to gas cooling. The heating rate between 700 to 900° C. was set to 12° C./second, and the heating rate between 900 to 1000° C. was set to 17° C./second. The surfaces of the hot rolled sheet annealed steel sheets were subjected to pickling to remove scales. After hot rolled sheet annealing, the annealed sheets were pickled and cold-rolled to a thickness of 1.5 mm. After cold rolling, the cold rolled sheets were subjected to intermediate annealing in which the steel sheets were held at 1080° C. for 60 seconds in an atmospheric gas of a dew point of 40° C. and 100% $H_2$. The C content was reduced by about 0.015% by the intermediate annealing. Further, in the intermediate annealing, quenching treatment at 30° C./second was carried out for an increase in solid solute C by spraying with water mist until the steel sheet temperature became room temperatures. After intermediate annealing, the above annealed sheets were pickled and subjected to warm rolling to obtain a final sheet thickness of 0.18 mm. Warm rolling was carried out at a steel sheet temperature of 220° C. Degreasing treatment was carried out after warm rolling. Grooves having a depth of 20 μm and a width of 150 μm were formed by electrolytic etching in a direction at an angle of 80 degrees to the rolling direction at an interval of 4 mm in the rolling direction, and then decarburization annealing was carried out at 840° C. for 2 minutes. An annealing separator prepared by adding 8% of $TiO_2$ to MgO was applied on the decarburization annealed sheets, and the sheets were wound up in the form of a coil and then subjected to final annealing. In the final annealing, the heating rate was set to 30° C./hr up to 850° C., 10.5° C./hr at 850 to 1150° C. and 15° C./hr at 1150 to 1180° C. Carried out were holding at 850° C. for 20 hours and purification treatment at 1180° C. for 4 hours, and then the temperature was lowered. Annealing atmospheric gases were 100% $N_2$ in heating and holding up to 850° C., a mixture of 20% $N_2$ and 80% $H_2$ in heating at 850 to 1150° C., 100% $H_2$ in heating at 1150 to 1180° C., purification at 1180° C. and cooling down to 700° C. and 100% $N_2$ in cooling from 600° C. After the final annealing, the unreacted annealing separator was removed from the surfaces of the steel sheets. After removing, a coating liquid comprising as a principal component magnesium phosphate containing 70% of colloidal silica was applied and baked at 800° C. to carry out tension coating, whereby the products were prepared.

Test pieces having a width of 150 mm and a length of 400 mm were cut out of the respective products to measure the magnetic characteristics. Further, the steel sheets were subjected to macro etching to determine the two-dimensional crystal grain distributions on the surfaces of the steel sheets and the sheet facial rotation angle averages (α) of the crystal grains from the (110) [001] orientation in the crystal grain orientations. Further, the product sheet compositions were analyzed by a wet chemical analytical method.

As shown in Table 10, the grain oriented electrical steel sheets falling in the composition range of the present invention and having average grain diameters, crystal grain distributions, orientation alignment degrees and impurity contents according to the present invention have very excellent iron losses.

Example 6

Six steel slabs having composition shown by mark I in Table 4 were heated to 1420° C. and then turned into hot rolled steel sheets having a sheet thickness of 2.4 mm. The outlet temperature of hot rolling was set to 980° C. The above hot rolled steel sheets were sprayed on the surfaces thereof with a large amount of cooling water to cool them to 500° C. at a cooling rate of 65° C./second and wound up in the form of a coil.

One group of two coils (sign I-1 and I-2) among the above hot rolled steel sheet coils were subjected to the hot rolled sheet annealing at 1050° C. for 60 seconds and then to gas cooling. The heating rate of two coils, I-1 and I-2, between 700 to 900° C. was set to 15 and 35° C./second respectively. After the hot rolled sheet annealing, the above two sheets were pickled and cold-rolled to a thickness of 1.5 mm.

Another group of two coils (sign I-3 and I-4) among the hot rolled sheet coils were subjected to the carbide size control annealing at 650° C. for 10 seconds and then to gas cooling. After the carbide size control annealing, the above annealed sheets were pickled and cold-rolled to thickness of 1.5 mm.

The other group of two coils (sign I-5 and I-4) among the hot rolled sheet coils were pickled and cold-rolled to thickness of 1.5 mm.

After cold rolling, these six cold rolled sheets were subjected to intermediate annealing in which the steel sheets were heated and held at 1080° C. for 50 seconds in an atmospheric gas of a dew point 35° C. and 55% $N_2$ and 45% $H_2$, which made the decarburized layers of 20 $\mu$m thickness on the steel sheet surfaces. Further, in the intermediate annealing, quenching treatment at 40° C./second was carried out by spraying with water mist in order to increase solid solute C.

The heating rate between 700 to 900° C. was set to 16° C./second for the coils, I-1, I-3 and I-5 and was set to 38° C./second for the coils, I-2, I-4 and I-6.

After intermediate annealing, the all annealed sheets were pickled and subjected to warm rolling at the maximum temperature of 250° C. to obtain a final sheet thickness of 0.22 mm.

After the final rolling, the warm rolled sheets were subjected to decarburization annealing at 850° C. for 2 minutes. An annealing separator prepared by adding 5% of $TiO_2$ to MgO was applied on the decarburized sheets, and the sheet were wound up in the form of a coil and then subjected to final annealing. In the final annealing, the heating rate was set to 30° C./h up to 850° C. and 12° C./h from 850° C. to 1200° C. Carried out were holding at 850° C. for 20 hours and purification treatment at 1200° C. for 5 hours, and then the temperature was lowered. Annealing atmospheric gases were 100% $N_2$ in heating and holding up to 850° C., a mixture of 25% $N_2$ and 75% $H_2$ in heating from 850 to 1200° C., 100% $H_2$ in purification treatment at 1200° C. and cooling down to 500° C. and 100% $N_2$ in cooling from 500° C. to 200° C.

After final annealing, the unreacted annealing separator was removed from the surfaces of the steel sheets. After removing, a coating liquid comprising as a principal component magnesium phosphate containing 65% of colloidal silica was applied and baked to carry out tension coating. After coating treatment, the steel sheets were linearly irradiated in the 80 degree direction from the rolling direction on the surfaces thereof with plasma jet at a pitch of 7 mm to prepare the products. The magnetic characteristics of these products are shown in Table 11.

Test pieces having a width of 150 mm and length of 400 mm were cut out of the respective products to measure the magnetic characteristics. Further, the steel sheets were subjected to macro etching to determine the two-dimensional crystal grain distributions on the surfaces of the steel sheets and the sheet facial rotation angle averages ($\alpha$) of the crystal grains from the (110) [001] orientation in the crystal grain orientations. Further, the product sheet compositions were analyzed.

The results are also shown in Table 11. As shown in Table 11, the grain oriented electrical steel sheets of the present invention provided excellent iron losses. Further, particularly, the products subjected to the heating rate of this invention between 700 to 900° C. in the first annealing over the temperature of 900° C. after hot rolling provided markedly excellent characteristics.

The present invention shall not be restricted to the embodiments described above and is intended to cover all equivalents.

As described above in detail, according to the grain oriented electrical steel sheet of the present invention and the production process for the same, a high magnetic flux density grain oriented electrical steel sheet having a very excellent iron loss can be produced.

TABLE 1

| Product code | Average crystal grain diameter (mm) | Crystal grain diameter distribution (%) 2 mm or less | 2–10 mm | 10 mm or more | Sheet facial rotation angle $\alpha$ (degree) | Steel analysis (ppm) C | S + Se | N | O | Al | Ti | $W_{17/50}$ (W/kg) | Remarks |
|---|---|---|---|---|---|---|---|---|---|---|---|---|---|
| A-1 | 22.4 | 3.7 | 25.5 | 70.8 | 5.6 | 12 | 5 | 4 | 8 | 3 | 14 | 0.82 | Inferior |
| A-2 | 9.2 | 4.7 | 0.0 | 95.3 | 2.2 | 11 | 4 | 5 | 11 | 2 | 12 | 0.66 | Good |
| B-1 | 24.8 | 0.5 | 29.6 | 69.9 | 6.3 | 12 | 4 | 6 | 10 | 5 | 10 | 0.84 | Inferior |
| B-2 | 28.3 | 0.8 | 0.0 | 99.2 | 3.8 | 10 | 3 | 4 | 9 | 6 | 11 | 0.78 | Inferior |
| C-1 | 11.4 | 0.0 | 37.5 | 62.5 | 12.4 | 13 | 5 | 5 | 10 | 7 | 8 | 0.86 | Inferior |
| C-2 | 34.1 | 0.0 | 2.4 | 97.6 | 4.8 | 12 | 5 | 5 | 8 | 6 | 4 | 0.81 | Inferior |
| D-1 | 10.3 | 0.0 | 51.5 | 48.5 | 13.2 | 32 | 6 | 4 | 10 | 7 | 14 | 0.98 | Inferior |
| D-2 | 18.6 | 3.1 | 20.8 | 76.1 | 10.6 | 34 | 5 | 4 | 11 | 5 | 12 | 0.92 | Inferior |
| E-1 | 8.9 | 0.0 | 40.2 | 59.8 | 10.3 | 11 | 3 | 6 | 11 | 4 | 8 | 0.91 | Inferior |
| E-2 | 28.7 | 0.0 | 3.4 | 96.6 | 6.8 | 11 | 4 | 5 | 10 | 5 | 7 | 0.88 | Inferior |
| F-1 | 6.5 | 1.4 | 27.8 | 70.8 | 6.0 | 15 | 5 | 4 | 11 | 4 | 13 | 0.83 | Inferior |
| F-2 | 10.3 | 4.8 | 0.0 | 95.2 | 2.6 | 12 | 5 | 7 | 9 | 7 | 15 | 0.85 | Good |
| G-1 | 7.4 | 0.0 | 65.3 | 34.7 | 6.4 | 16 | 4 | 5 | 10 | 6 | 10 | 0.85 | Inferior |
| G-2 | 28.8 | 0.0 | 4.7 | 96.3 | 6.6 | 14 | 3 | 5 | 9 | 4 | 12 | 0.87 | Inferior |

TABLE 2

| Code | 500–700° C. | | 700–800° C. | | 800–900° C. | | 900–1000° C. | | 1000–1100° C. | | 1100–1200° C. | | 1200° C. × 5 hr | | Remarks |
|---|---|---|---|---|---|---|---|---|---|---|---|---|---|---|---|
| | $N_2$ (%) | $H_2$ (%) | $N_2$ (%) | $H_2$ (%) | $N_2$ (%) | $H_2$ (%) | $N_2$ (%) | $H_2$ (%) | $N_2$ (%) | $H_2$ (%) | $N_2$ (%) | $H_2$ (%) | $N_2$ (%) | $H_2$ (%) | |
| A-3 | 100 | 0 | 100 | 0 | 100 | 0 | 100 | 0 | 100 | 0 | 25 | 75 | 0 | 100 | $H_2$ insufficient |
| A-4 | 100 | 0 | 100 | 0 | 100 | 0 | 100 | 0 | 10 | 90 | 100 | 0 | 0 | 100 | $H_2$ insufficient |
| A-5 | 100 | 0 | 100 | 0 | 100 | 0 | 15 | 85 | 0 | 100 | 0 | 100 | 0 | 100 | Good conditions |
| A-6 | 100 | 0 | 70 | 30 | 60 | 40 | 30 | 70 | 15 | 85 | 10 | 90 | 10 | 90 | Good conditions |
| A-7 | 95 | 5 | 95 | 5 | 25 | 75 | 10 | 90 | 5 | 95 | 5 | 95 | 5 | 95 | Good conditions |
| A-8 | 100 | 0 | 100 | 0 | 40 | 60 | 20 | 80 | 0 | 100 | 0 | 100 | 0 | 100 | Good conditions |
| A-9 | 100 | 0 | 100 | 0 | 70 | 30 | 0 | 100 | 0 | 100 | 0 | 100 | 0 | 100 | $H_2$ insufficient |
| A-10 | 100 | 0 | 60 | 40 | 0 | 100 | 0 | 100 | 0 | 100 | 0 | 100 | 0 | 100 | $H_2$ insufficient |

TABLE 3

| Product code | Average crystal grain diameter (mm) | Crystal grain diameter distribution (%): 2 mm or less | 2–10 mm | 10 mm or more | Sheet facial rotation angle α (degree) | Steel analysis (ppm): C | S + Se | N | O | Al | Ti | $W_{17/50}$ (W/kg) | Remarks |
|---|---|---|---|---|---|---|---|---|---|---|---|---|---|
| A-3 | 7.3 | 0.0 | 43.7 | 56.3 | 8.6 | 16 | 5 | 3 | 10 | 3 | 10 | 0.86 | Inferior |
| A-4 | 9.6 | 1.2 | 26.0 | 72.8 | 5.9 | 11 | 7 | 4 | 9 | 5 | 14 | 0.83 | Inferior |
| A-5 | 12.6 | 4.3 | 0.0 | 95.7 | 2.0 | 13 | 5 | 6 | 11 | 4 | 12 | 0.66 | Good |
| A-6 | 8.5 | 5.6 | 0.0 | 94.4 | 2.3 | 12 | 6 | 3 | 10 | 5 | 5 | 0.64 | Good |
| A-7 | 9.8 | 4.2 | 0.0 | 95.8 | 2.2 | 14 | 8 | 4 | 12 | 3 | 8 | 0.65 | Good |
| A-8 | 7.8 | 5.3 | 1.3 | 93.4 | 1.9 | 13 | 6 | 5 | 11 | 4 | 22 | 0.67 | Good |
| A-9 | 10.5 | 3.8 | 0.0 | 96.2 | 2.1 | 15 | 7 | 4 | 10 | 5 | 32 | 0.78 | Inferior |
| A-10 | 9.6 | 4.7 | 0.0 | 95.3 | 2.4 | 16 | 5 | 6 | 12 | 5 | 36 | 0.82 | Inferior |

TABLE 4

| Slab code | Composition (wt %) (B and N: values in ppm) (tr = trace): C | Si | Mn | P | S | Al | Se | Ni | Sb | Ge |
|---|---|---|---|---|---|---|---|---|---|---|
| A | 0.06 | 3.50 | 0.07 | 0.05 | 0.005 | 0.023 | 0.018 | 0.35 | 0.068 | tr |
| B | 0.06 | 3.52 | 0.07 | 0.04 | 0.005 | 0.024 | 0.018 | 0.04 | 0.065 | tr |
| C | 0.06 | 3.51 | 0.07 | 0.05 | 0.005 | 0.024 | 0.018 | tr | 0.067 | tr |
| D | 0.09 | 3.51 | 0.07 | 0.04 | 0.004 | 0.024 | 0.017 | 0.33 | 0.067 | tr |
| E | 0.09 | 3.52 | 0.07 | 0.04 | 0.005 | 0.024 | 0.018 | tr | 0.028 | tr |
| F | 0.09 | 3.50 | 0.07 | 0.04 | 0.005 | 0.024 | 0.017 | 0.04 | 0.026 | tr |
| G | 0.09 | 3.45 | 0.07 | 0.05 | 0.003 | 0.024 | tr | 0.22 | 0.024 | tr |
| H | 0.07 | 3.52 | 0.07 | 0.08 | 0.003 | 0.023 | 0.016 | 0.25 | 0.050 | 0.04 |
| I | 0.07 | 3.48 | 0.07 | 0.05 | 0.004 | 0.024 | 0.018 | 0.27 | 0.045 | tr |
| J | 0.08 | 3.50 | 0.07 | 0.08 | 0.004 | 0.022 | 0.017 | 0.42 | 0.035 | tr |
| K | 0.06 | 3.47 | 0.07 | 0.06 | 0.003 | 0.025 | 0.019 | 0.28 | 0.046 | tr |
| L | 0.07 | 3.52 | 0.07 | 0.03 | 0.014 | 0.024 | tr | 0.36 | 0.053 | tr |
| M | 0.08 | 3.50 | 0.07 | 0.12 | 0.003 | 0.024 | 0.018 | 0.25 | 0.042 | tr |
| N | 0.07 | 3.47 | 0.07 | 0.11 | 0.016 | 0.023 | tr | 0.37 | 0.048 | tr |
| O | 0.07 | 3.52 | 0.07 | 0.04 | 0.003 | 0.023 | 0.017 | 0.10 | 0.042 | tr |
| P | 0.07 | 3.49 | 0.07 | 0.05 | 0.004 | 0.023 | 0.016 | 0.23 | 0.044 | tr |
| Q | 0.07 | 3.46 | 0.07 | 0.06 | 0.004 | 0.024 | 0.018 | 0.26 | 0.046 | tr |
| R | 0.07 | 3.50 | 0.07 | 0.04 | 0.003 | 0.024 | 0.017 | 0.18 | 0.049 | tr |
| S | 0.08 | 3.52 | 0.07 | 0.04 | 0.002 | 0.022 | 0.018 | 0.22 | 0.032 | tr |
| T | 0.07 | 3.48 | 0.07 | 0.05 | 0.003 | 0.022 | 0.018 | 0.42 | 0.051 | tr |

TABLE 4-continued

| Slab code | Composition (wt %) (B and N: values in ppm) (tr = trace) Cu | Nb | Bi | Sn | V | Cr | Te | Mo | B | N | Remarks |
|---|---|---|---|---|---|---|---|---|---|---|---|
| A | 0.002 | tr | tr | 0.003 | tr | 0.002 | tr | tr | 0.8 | 82 | Suited |
| B | 0.004 | tr | tr | 0.004 | tr | 0.001 | tr | tr | 1.0 | 85 | Unsuited |
| C | 0.002 | tr | tr | 0.002 | tr | 0.002 | tr | tr | 1.5 | 82 | Unsuited |
| D | 0.003 | tr | tr | 0.002 | tr | 0.004 | tr | tr | 1.8 | 83 | Unsuited |
| E | 0.003 | tr | tr | 0.004 | tr | 0.002 | tr | tr | 1.1 | 84 | Unsuited |
| F | 0.002 | tr | tr | 0.002 | tr | 0.002 | tr | tr | 1.2 | 83 | Suited |
| G | 0.003 | tr | tr | 0.002 | tr | 0.003 | tr | tr | 1.0 | 82 | Unsuited |
| H | 0.002 | tr | tr | 0.002 | tr | 0.003 | tr | tr | 0.5 | 76 | Suited |
| I | 0.12 | tr | tr | 0.004 | tr | 0.002 | tr | tr | 0.9 | 78 | Suited |
| J | 0.002 | 0.02 | tr | 0.003 | tr | 0.004 | tr | tr | 1.3 | 86 | Suited |
| K | 0.017 | tr | 0.009 | 0.003 | tr | 0.001 | tr | tr | 0.3 | 80 | Suited |
| L | 0.006 | tr | tr | 0.15 | tr | 0.002 | tr | tr | 1.0 | 81 | Suited |
| M | 0.003 | tr | tr | 0.004 | 0.025 | 0.004 | tr | tr | 1.6 | 73 | Suited |
| N | 0.012 | tr | tr | 0.003 | tr | 0.12 | tr | tr | 1.7 | 84 | Suited |
| O | 0.002 | tr | tr | 0.003 | tr | 0.003 | 0.020 | tr | 1.5 | 75 | Suited |
| P | 0.009 | tr | tr | 0.002 | tr | 0.003 | tr | 0.015 | 2.5 | 77 | Suited |
| Q | 0.002 | tr | tr | 0.002 | tr | 0.002 | tr | tr | 23 | 88 | Suited |
| R | 0.15 | tr | 0.035 | 0.003 | tr | 0.004 | tr | tr | 1.1 | 83 | Suited |
| S | 0.08 | tr | tr | 0.003 | tr | 0.15 | tr | tr | 0.9 | 85 | Suited |
| T | 0.13 | tr | tr | 0.28 | tr | 0.002 | tr | tr | 1.4 | 80 | Suited |

TABLE 5

| Slab code | Average crystal grain diameter (mm) | Crystal grain diameter distribution (%): 2 mm or less | 2–10 mm | 10 mm or more | Sheet facial rotation angle α (degree) | Steel analysis (ppm): C | S + Se | N | O | Al | Ti | $W_{17/50}$ (W/kg) | Remarks |
|---|---|---|---|---|---|---|---|---|---|---|---|---|---|
| A | 9.3 | 4.5 | 0.0 | 95.5 | 2.3 | 12 | 4 | 4 | 12 | 4 | 12 | 0.66 | Invention |
| B | 30.2 | 0.8 | 0.0 | 99.2 | 3.7 | 10 | 4 | 3 | 10 | 3 | 11 | 0.79 | Comparison |
| C | 33.8 | 0.0 | 3.4 | 96.6 | 4.9 | 12 | 5 | 5 | 10 | 5 | 11 | 0.83 | Comparison |
| D | 16.7 | 4.2 | 32.1 | 63.7 | 9.4 | 15 | 6 | 4 | 12 | 4 | 13 | 0.94 | Comparison |
| E | 29.8 | 0.0 | 5.3 | 94.7 | 7.2 | 11 | 4 | 4 | 11 | 5 | 12 | 0.87 | Comparison |
| F | 10.6 | 3.1 | 0.0 | 96.9 | 2.4 | 10 | 4 | 4 | 12 | 3 | 13 | 0.64 | Invention |
| G | 6.8 | 0.0 | 82.3 | 17.7 | 6.5 | 12 | 3 | 5 | 9 | 4 | 12 | 0.83 | Comparison |
| H | 17.3 | 2.6 | 0.0 | 97.4 | 2.6 | 13 | 4 | 4 | 13 | 3 | 12 | 0.67 | Invention |
| I | 15.4 | 3.2 | 0.0 | 96.8 | 2.7 | 12 | 4 | 3 | 10 | 4 | 9 | 0.67 | Invention |
| J | 9.8 | 3.0 | 5.5 | 91.5 | 3.0 | 13 | 5 | 5 | 10 | 4 | 10 | 0.68 | Invention |
| K | 23.5 | 2.8 | 0.0 | 97.2 | 1.7 | 17 | 4 | 4 | 13 | 7 | 8 | 0.63 | Invention |
| L | 11.6 | 2.4 | 4.3 | 93.3 | 2.8 | 10 | 3 | 4 | 9 | 3 | 13 | 0.67 | Invention |
| M | 13.5 | 3.8 | 2.5 | 93.7 | 2.8 | 11 | 5 | 4 | 11 | 4 | 11 | 0.67 | Invention |
| N | 17.2 | 3.4 | 0.0 | 96.6 | 2.5 | 12 | 4 | 4 | 14 | 4 | 10 | 0.66 | Invention |
| O | 21.5 | 2.1 | 0.0 | 97.9 | 1.9 | 12 | 3 | 4 | 12 | 3 | 12 | 0.64 | Invention |
| P | 12.8 | 3.0 | 0.0 | 97.0 | 2.7 | 14 | 5 | 5 | 12 | 3 | 12 | 0.67 | Invention |
| Q | 9.6 | 4.3 | 2.1 | 93.6 | 2.8 | 10 | 4 | 3 | 12 | 4 | 12 | 0.68 | Invention |
| R | 19.6 | 3.1 | 0.0 | 96.9 | 1.3 | 16 | 4 | 4 | 14 | 6 | 7 | 0.62 | Invention |
| S | 14.4 | 3.8 | 0.0 | 96.2 | 2.5 | 10 | 3 | 4 | 11 | 4 | 10 | 0.67 | Invention |
| T | 9.5 | 4.1 | 4.8 | 91.1 | 2.8 | 12 | 5 | 4 | 8 | 3 | 13 | 0.68 | Invention |

TABLE 6

| Code | Average crystal grain diameter (mm) | Crystal grain diameter distribution (%): 2 mm or less | 2–10 mm | 10 mm or more | Sheet facial rotation angle α (degree) | Steel analysis (ppm): C | S + Se | N | O | Al | Ti | Iron loss $W_{17/50}$ (W/kg) | Remarks |
|---|---|---|---|---|---|---|---|---|---|---|---|---|---|
| a | 4.6 | 4.5 | 59.3 | 36.2 | 7.5 | 12 | 4 | 4 | 11 | 5 | 12 | 0.88 | Comparison |
| b | 6.8 | 3.4 | 27.6 | 69.0 | 6.3 | 13 | 4 | 3 | 10 | 4 | 10 | 0.83 | Comparison |
| c | 9.3 | 3.1 | 0.0 | 96.9 | 2.6 | 12 | 5 | 4 | 12 | 3 | 10 | 0.75 | Invention |
| d | 12.5 | 2.8 | 0.0 | 97.2 | 2.2 | 14 | 4 | 4 | 10 | 6 | 11 | 0.73 | Invention |

TABLE 6-continued

| Code | Average crystal grain diameter (mm) | Crystal grain diameter distribution (%) 2 mm or less | 2–10 mm | 10 mm or more | Sheet facial rotation angle α (degree) | Steel analysis (ppm) C | S + Se | N | O | Al | Ti | Iron loss $W_{17/50}$ (W/kg) | Remarks |
|---|---|---|---|---|---|---|---|---|---|---|---|---|---|
| e | 16.2 | 2.6 | 0.0 | 97.4 | 2.1 | 12 | 3 | 4 | 9 | 5 | 12 | 0.72 | Invention |
| f | 13.4 | 2.4 | 0.0 | 97.6 | 2.5 | 13 | 5 | 3 | 12 | 4 | 11 | 0.74 | Invention |
| g | 7.3 | 3.5 | 24.8 | 71.7 | 6.6 | 13 | 4 | 4 | 11 | 3 | 11 | 0.84 | Comparison |

TABLE 7

| Code | Average crystal grain diameter (mm) | Crystal grain diameter distribution (%) 2 mm or less | 2–10 mm | 10 mm or more | Sheet facial rotation angle α (degree) | Steel analysis (ppm) C | S + Se | N | O | Al | Ti | $W_{17/50}$ (W/kg) | Remarks |
|---|---|---|---|---|---|---|---|---|---|---|---|---|---|
| h | 5.7 | 8.9 | 28.5 | 62.6 | 5.8 | 8 | 4 | 4 | 11 | 4 | 9 | 0.75 | Comparison |
| i | 18.2 | 1.8 | 0.0 | 98.2 | 2.1 | 7 | 3 | 4 | 12 | 5 | 8 | 0.61 | Invention |
| j | 15.6 | 2.5 | 0.0 | 97.5 | 2.2 | 8 | 3 | 4 | 10 | 3 | 12 | 0.62 | Invention |
| k | 6.3 | 5.8 | 32.9 | 61.3 | 6.3 | 8 | 4 | 3 | 9 | 4 | 11 | 0.78 | Comparison |

TABLE 8

| Slab code | Spot heating treatment | Coil name | Final finishing annealing atmosphere | Average crystal grain diameter (mm) | Crystal grain diameter distribution (%) 2 mm or less | 2–10 mm | 10 mm or more | Sheet facial rotation angle α (degree) | Steel analysis (ppm) C | S + Se | N | O | Al | Ti | $W_{17/50}$ (W/kg) | Three phase transformer iron loss $W_{17/50}$ (W/kg) | Remarks |
|---|---|---|---|---|---|---|---|---|---|---|---|---|---|---|---|---|---|
| E | None | l | N2 type | 35.4 | 0.0 | 12.7 | 87.3 | 8.7 | 12 | 5 | 4 | 10 | 4 | 8 | 0.80 | 0.95 | Comparison |
| | | m | H2 type | 30.4 | 1.3 | 24.5 | 74.2 | 9.4 | 10 | 4 | 3 | 12 | 3 | 24 | 0.82 | 0.98 | Comparison |
| P | None | n | N2 type | 13.5 | 2.8 | 0.0 | 97.2 | 2.3 | 8 | 5 | 5 | 9 | 4 | 8 | 0.62 | 0.74 | Invention |
| | | o | H2 type | 10.2 | 3.6 | 0.0 | 96.4 | 2.6 | 11 | 4 | 4 | 8 | 6 | 33 | 0.79 | 0.92 | Comparison |
| | Present | p | N2 type | 6.7 | 4.9 | 0.0 | 95.1 | 2.5 | 12 | 5 | 5 | 10 | 4 | 9 | 0.61 | 0.66 | Invention |
| | | q | H2 type | 5.4 | 5.2 | 0.0 | 94.8 | 2.8 | 10 | 5 | 3 | 8 | 5 | 36 | 0.78 | 0.88 | Comparison |

TABLE 9

| Slab code | Composition (wt %) (B and N: values by ppm) C | Si | Mn | P | S | Al | Se | Ni | Sb | Cu | Sn | Cr | Te | Mo | B | N | Remarks |
|---|---|---|---|---|---|---|---|---|---|---|---|---|---|---|---|---|---|
| UA | 0.06 | 3.35 | 0.07 | 0.003 | 0.003 | 0.008 | 0.018 | 0.25 | 0.068 | 0.010 | 0.003 | 0.005 | tr | tr | 28 | 76 | Suited |
| UB | 0.06 | 3.38 | 0.08 | 0.005 | 0.004 | 0.009 | 0.018 | 0.03 | 0.063 | 0.011 | 0.002 | 0.002 | tr | tr | 32 | 82 | Unsuited |
| UC | 0.06 | 3.36 | 0.07 | 0.007 | 0.003 | 0.007 | 0.017 | tr | 0.060 | 0.007 | 0.004 | 0.004 | tr | tr | 25 | 80 | Unsuited |
| UD | 0.09 | 3.35 | 0.07 | 0.003 | 0.005 | 0.008 | 0.018 | 0.38 | 0.057 | 0.011 | 0.005 | 0.002 | tr | tr | 33 | 78 | Unsuited |
| UE | 0.09 | 3.37 | 0.07 | 0.005 | 0.003 | 0.005 | 0.018 | 0.40 | 0.025 | 0.008 | 0.003 | 0.004 | tr | tr | 30 | 76 | Unsuited |
| UF | 0.07 | 3.59 | 0.07 | 0.005 | 0.002 | 0.003 | 0.017 | 0.04 | 0.035 | 0.010 | 0.004 | 0.005 | tr | tr | 27 | 81 | Suited |
| UG | 0.06 | 3.41 | 0.08 | 0.004 | 0.008 | 0.002 | 0.019 | 0.20 | 0.053 | 0.005 | 0.008 | 0.007 | tr | tr | 2.3 | 68 | Unsuited |
| UH | 0.07 | 3.57 | 0.08 | 0.08 | 0.016 | 0.008 | tr | 0.25 | 0.051 | 0.012 | 0.010 | 0.13 | tr | tr | 28 | 78 | Suited |
| UI | 0.09 | 3.45 | 0.07 | 0.003 | 0.009 | 0.007 | 0.018 | 0.28 | 0.054 | 0.008 | 0.010 | 0.009 | tr | tr | 33 | 75 | Suited |
| UJ | 0.08 | 3.67 | 0.07 | 0.004 | 0.003 | 0.006 | 0.019 | 0.32 | 0.045 | 0.12 | 0.005 | 0.003 | tr | tr | 28 | 82 | Suited |
| UK | 0.07 | 3.54 | 0.08 | 0.005 | 0.016 | 0.005 | tr | 0.25 | 0.038 | 0.005 | 0.007 | 0.008 | 0.02 | 0.012 | 25 | 76 | Suited |
| UL | 0.08 | 3.52 | 0.08 | 0.08 | 0.017 | 0.007 | tr | 0.28 | 0.042 | 0.003 | 0.006 | 0.005 | tr | 0.010 | 34 | 79 | Suited |

Note) B and N: values by ppm

TABLE 10

| Slab code | Average crystal grain diameter (mm) | Crystal grain diameter distribution (%) 2 mm or less | 2–10 mm | 10 mm or more | Sheet facial rotation angle α (degree) | Steel analysis (ppm) C | S + Se | N | O | Al | Ti | $W_{17/50}$ (W/kg) | Remarks |
|---|---|---|---|---|---|---|---|---|---|---|---|---|---|
| UA | 8.4 | 8.3 | 0.4 | 97.3 | 2.8 | 12 | 4 | 4 | 8 | 2 | 8 | 0.63 | Invention |
| UB | 28.5 | 1.3 | 0.3 | 98.4 | 3.5 | 13 | 4 | 5 | 7 | 2 | 7 | 0.70 | Comparison |
| UC | 34.5 | 0.0 | 3.2 | 96.8 | 5.3 | 12 | 5 | 3 | 8 | 3 | 5 | 0.73 | Comparison |
| UD | 15.3 | 2.5 | 37.0 | 60.5 | 8.8 | 11 | 3 | 4 | 10 | 2 | 7 | 0.80 | Comparison |
| UE | 5.8 | 0.0 | 87.7 | 12.3 | 8.2 | 14 | 3 | 5 | 11 | 2 | 6 | 0.78 | Comparison |
| UF | 14.7 | 1.8 | 3.5 | 94.7 | 24 | 8 | 4 | 2 | 9 | 2 | 3 | 0.62 | Invention |
| UG | 1.3 | 95.5 | 4.5 | 0 | 18.5 | 10 | 6 | 2 | 10 | 4 | 8 | 1.04 | Comparison |
| UH | 9.5 | 7.3 | 0.0 | 91.7 | 2.5 | 11 | 5 | 3 | 8 | 3 | 12 | 0.62 | Invention |
| UI | 22.5 | 2.1 | 2.3 | 95.6 | 2.0 | 12 | 4 | 4 | 8 | 2 | 11 | 0.60 | Invention |
| UJ | 13.5 | 6.2 | 0.4 | 93.4 | 1.8 | 11 | 4 | 4 | 10 | 2 | 10 | 0.62 | Invention |
| UK | 22.2 | 3.1 | 0.4 | 96.5 | 2.2 | 12 | 5 | 5 | 11 | 2 | 8 | 0.63 | Invention |
| UL | 23.8 | 2.7 | 1.3 | 96.0 | 1.7 | 10 | 4 | 4 | 10 | 2 | 7 | 0.62 | Invention |

TABLE 11

| Sign | Average crystal grain diameter (mm) | Crystal grain diameter distribution (%) 2 mm or less | 2–10 mm | 10 mm or more | Sheet facial rotation angle α (degree) | Steel analysis (ppm) C | S + Se | N | O | Al | Ti | $W_{17/50}$ (W/kg) | Heating rate between 700 to 900° C. of 1st annealing over 900° C. (° C./second) | Remarks |
|---|---|---|---|---|---|---|---|---|---|---|---|---|---|---|
| I-1 | 16.3 | 4.4 | 0.0 | 95.6 | 2.6 | 11 | 5 | 4 | 8 | 4 | 9 | 0.66 | 15 | Invention |
| I-2 | 2.6 | 8.5 | 28.0 | 63.5 | 15.3 | 12 | 3 | 4 | 10 | 3 | 8 | 1.18 | 35 | Comparison |
| I-3 | 15.5 | 3.3 | 0.0 | 96.7 | 1.8 | 10 | 4 | 4 | 9 | 4 | 10 | 0.63 | 16 | Invention |
| I-4 | 4.3 | 6.2 | 41.4 | 52.4 | 12.6 | 11 | 4 | 3 | 11 | 4 | 9 | 1.03 | 38 | Comparison |
| I-5 | 17.3 | 3.6 | 0.0 | 96.4 | 2.8 | 12 | 4 | 3 | 8 | 4 | 8 | 0.68 | 16 | Invention |
| I-6 | 5.6 | 5.3 | 70.1 | 24.6 | 7.3 | 11 | 4 | 4 | 9 | 4 | 8 | 0.92 | 38 | Comparison |

What is claimed is:

1. A grain oriented electrical steel sheet having a very low iron loss, said sheet comprising a plurality of secondary recrystallized grains in which the average of sheet facial rotation angles of grain directions from the (110) [001] orientation falls within about 4 degrees, and wherein crystal grains having a grain diameter of about 10 mm or more comprise about 75% or more expressed as area proportion.

2. The grain oriented electrical steel sheet defined in claim 1, wherein said sheet comprising about 1.5 to 7.0 wt % of Si, about 0.005 to 2.5 wt % of one or more species selected from the group consisting of Mn, Cu, Sn, Ge, Bi, V, Nb, Cr, Te and Mo, expressed as a single species or a total of two or more species thereof, and about 0.005 to 0.30 wt % of P as inhibitor auxiliary elements, said sheet further comprising about 0.005 to 1.0 wt % of Ni, about 0.02 to 0.15 wt % of Sb and about 0 to 0.0050 wt % of B, and substantially satisfying the relationship:

$$0.02 \leqq Y \leqq 1.0,\ 5(X-0.05) \leqq Y \leqq 10X,$$

wherein X represents Sb content (wt %), and Y represents Ni content (wt %), said sheet further comprising impurities no more than about 0.003 wt % or less of C, about 0.003 wt % or less of S and Se in total, about 0.003 wt % or less of N, about 0.002 wt % or less of Al and about 0.003 wt % or less of Ti, and the remainder comprising other incidental or inevitable impurities and Fe.

3. The grain oriented electrical steel sheet defined in claim 1 or 2, wherein a plurality of grooves having a width of about 50 to 1000 μm and a depth of about 10 to 50 μm are provided on the steel sheet surface, arranged in a direction crossing the rolling direction of said sheet.

4. The grain oriented electrical steel sheet defined in claims 1 or 2, wherein fine crystal grains having a grain diameter of about 2 mm or less are disposed inside of coarse crystal grains having a grain diameter up to about 25 mm.

5. The grain oriented electrical steel sheet defined in claims 1 or 2, wherein said steel sheet has a surface that has been subjected to a mirror face treatment or crystal orientation-intensifying treatment, and wherein a finish coating has been provided on the surface of the steel sheet.

6. A grain oriented electrical steel sheet having a very low iron loss, said sheet comprising a plurality of secondary recrystallized grains in which the average of sheet facial rotation angles of grain directions from the (110) [001] orientation falls within about 4 degrees, wherein crystal grains having a grain diameter of about 10 mm or more comprise about 75% or more expressed as area proportion, and wherein said steel sheet has an iron loss value ($W_{17/50}$) of 0.60–0.74.

7. The steel sheet defined in claim 6, wherein said iron loss value ($W_{17/50}$) is 0.60–0.68.

8. The steel sheet defined in claim 6, wherein said iron loss value ($W_{17/50}$) is 0.60–0.65.

* * * * *

UNITED STATES PATENT AND TRADEMARK OFFICE

CERTIFICATE OF CORRECTION

PATENT NO. : 6,103,022
DATED : August 15, 2000
INVENTOR(S) : Komatsubara et al

It is certified that error appears in the above-identified patent and that said Letters Patent is hereby corrected as shown below:

In Column 8, at line 17, please change "a" to -- $\propto$ --.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*